US007338718B2

(12) United States Patent
Taira et al.

(10) Patent No.: US 7,338,718 B2
(45) Date of Patent: Mar. 4, 2008

(54) ZINC HOT DIP GALVANIZED STEEL PLATE EXCELLENT IN PRESS FORMABILITY AND METHOD FOR PRODUCTION THEREOF

(75) Inventors: Shoichiro Taira, Tokyo (JP); Masaki Tada, Tokyo (JP); Yoshiharu Sugimoto, Tokyo (JP); Masayasu Nagoshi, Tokyo (JP); Takashi Kawano, Tokyo (JP); Etsuo Hamada, Tokyo (JP); Satoru Ando, Tokyo (JP); Shinji Ootsuka, Tokyo (JP); Masaaki Yamashita, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 167 days.

(21) Appl. No.: 10/521,474

(22) PCT Filed: Oct. 17, 2003

(86) PCT No.: PCT/JP03/13281

§ 371 (c)(1),
(2), (4) Date: Feb. 9, 2005

(87) PCT Pub. No.: WO2004/094683

PCT Pub. Date: Nov. 4, 2004

(65) Prior Publication Data

US 2005/0139291 A1 Jun. 30, 2005

(30) Foreign Application Priority Data

Apr. 18, 2003 (JP) ..... 2003-113938

(51) Int. Cl.
*B32B 15/04* (2006.01)
*C23C 2/06* (2006.01)
*C23C 2/26* (2006.01)

(52) U.S. Cl. ..... 428/633; 428/632; 428/659; 428/687

(58) Field of Classification Search ..... None
See application file for complete search history.

(56) References Cited

U.S. PATENT DOCUMENTS 5,525,431 A 6/1996 Kanamaru et al.
2003/0175548 A1* 9/2003 Taira et al. ..... 428/659

FOREIGN PATENT DOCUMENTS

EP 0 423 624 A1 4/1991

(Continued)

OTHER PUBLICATIONS

Translation of JP 2000-160358.*

(Continued)

*Primary Examiner*—John J Zimmerman
(74) *Attorney, Agent, or Firm*—Frishauf, Holtz, Goodman & Chick, P.C.

(57) ABSTRACT

A hot-dip galvanized steel sheet includes a plating layer substantially composed of the η phase and an oxide layer disposed on a surface of the plating layer. The oxide layer has an average thickness of 10 nm or more and includes a Zn-based oxide layer and an Al-based oxide layer. A method for producing the hot-dip galvanized steel sheet includes a hot-dip galvanization step, a temper rolling step, and an oxidation step.

18 Claims, 2 Drawing Sheets

FOREIGN PATENT DOCUMENTS

| | | | | |
|---|---|---|---|---|
| EP | 0 778 362 | A2 | | 6/1997 |
| EP | 1 288 325 | A1 | | 3/2003 |
| JP | 02-190483 | A | | 7/1990 |
| JP | 02-258963 | | * | 10/1990 |
| JP | 03-191091 | A | | 8/1991 |
| JP | 03-191092 | A | | 8/1991 |
| JP | 03-191093 | A | | 8/1991 |
| JP | 03-191094 | A | | 8/1991 |
| JP | 10-204600 | | * | 8/1998 |
| JP | 10-204600 | A | | 8/1998 |
| JP | 11-302812 | | * | 11/1999 |
| JP | 2001-131772 | | * | 5/2001 |
| JP | 2001-323358 | | | 11/2001 |
| JP | 2002-004019 | A | | 1/2002 |
| JP | 2002-004020 | A | | 1/2002 |
| JP | 2002-012958 | | * | 1/2002 |
| JP | 2002-256448 | | * | 9/2002 |

OTHER PUBLICATIONS

Translation of JP 2001-323358.*
Translation of JP 10-204600.*

* cited by examiner

ZINC HOT DIP GALVANIZED STEEL PLATE EXCELLENT IN PRESS FORMABILITY AND METHOD FOR PRODUCTION THEREOF

This application is the United States national phase application of International Application PCT/JP2003/013281 filed Oct. 17, 2003.

FIELD OF THE INVENTION

The present invention relates to hot-dip galvanized steel sheets having excellent press formability and methods for producing the same.

DESCRIPTION OF THE RELATED ARTS

Recently, in view of improvement in rust preventive properties, the rate of use of zinc-based plated steel sheets, in particular, hot-dip zinc-based coated steel sheets, for automotive panels has been increasing. Hot-dip zinc-based coated steel sheets are classified into those subjected to alloying treatment after being galvanized and those not subjected to alloying treatment. In general, the former are referred to as hot-dip galvannealed steel sheets and the latter are referred to as hot-dip galvanized steel sheets. Usually, as the hot-dip zinc-based coated steel sheets for automotive panels, hot-dip galvannealed steel sheets which are produced by hot-dip galvanizing and subsequent alloying treatment at about 500° C. are usually used because of their excellent weldability and paintability.

In order to further improve rust-preventive properties, there has been an increased demand from automotive manufacturers for zinc-based plated steel sheets with a heavy coating weight. If the coating weight of the hot-dip galvannealed steel sheets is increased, a long time is required for alloying, and incomplete alloying, i.e., so-called uneven burning, easily occurs. On the other hand, if alloying is attempted to be completed over the entire plating layer, overalloying occurs. As a result, a brittle Γ phase is generated at the interface between the plating layer and the steel sheet, and plating peeling is likely to occur during working. Therefore, it is extremely difficult to produce hot-dip galvannealed steel sheets with a heavy coating weight.

Consequently, hot-dip galvanized steel sheets are effective in allowing the coating weight to be increased. However, when a hot-dip galvanized steel sheet is press-formed into an automotive panel, sliding friction with a die is larger compared with a hot-dip galvannealed steel sheet. Since the melting point of the surface is low, adhesion is likely to occur, resulting in cracking during pressing.

In order to solve such problems, Japanese Unexamined Patent Publication No. 2002-4019 (Patent Literature 1) and Japanese Unexamined Patent Publication No. 2002-4020 (Patent Literature 2) disclose a technique in which die galling is prevented at the time of press forming by controlling the surface roughness of the hot-dip galvanized steel sheet and a technique in which deep drawability is improved. As a result of extensive research of such hot-dip galvanized steel sheets, it has been found that when a hot-dip galvanized steel sheet slides over a die and when the sliding distance is short, adhesion to the die is prevented. However, as the sliding distance is increased, such an effect is weakened, and depending on the sliding conditions, no improvement effect is achieved. In the disclosures described above, in order to impart roughness to the hot-dip galvanized steel sheet, a method is described in which roller conditions and rolling conditions in skin-pass rolling are controlled. In practice, since rollers become clogged with zinc, it is difficult to impart a predetermined roughness to the surface of the hot-dip galvanized steel sheet stably.

Japanese Unexamined Patent Publication No. 2-190483 (Patent Literature 3) discloses a galvanized steel sheet in which an oxide layer primarily composed of ZnO is formed on the surface of the plating layer. However, it is difficult to apply this technique to a hot-dip galvanized steel sheet. When a hot-dip galvanized steel sheet is produced, usually, a very small amount of Al is incorporated into a zinc bath so as to prevent an excessive Fe—Zn alloying reaction and to secure plating adhesion during dipping in the zinc bath. Because of the very small amount of Al involved, an Al-based oxide layer is densely generated on the surface of the hot-dip galvanized steel sheet. Therefore, the surface is inactive and it is not possible to form an oxide layer primarily composed of ZnO on the surface. Even if such an oxide layer is applied onto the densely generated Al-based oxide layer, adhesion between the applied oxide layer and the substrate is poor, and thus it is not possible to achieve a satisfactory effect. The oxide layer is also likely to adhere to the press die during working, resulting in adverse effects on the pressed article, for example, the formation of dents.

In addition, Japanese Unexamined Patent Publication No. 3-191091 (Patent Literature 4) discloses a galvanized steel sheet provided with an Mo oxide layer on the surface, Japanese Unexamined Patent Publication No. 3-191092 (Patent Literature 5) discloses a galvanized steel sheet provided with a Co oxide layer on the surface, Japanese Unexamined Patent Publication No. 3-191093 (Patent Literature 6) discloses a galvanized steel sheet provided with a Ni oxide layer on the surface, and Japanese Unexamined Patent Publication No. 3-191094 (Patent Literature 7) discloses a galvanized steel sheet provided with a Ca oxide layer on the surface. However, for the same reason as for the oxide layer primarily composed of ZnO, it is not possible to achieve a satisfactory effect.

Japanese Unexamined Patent Publication No. 2000-160358 (Patent Literature 8) discloses a galvanized steel sheet provided with an oxide layer composed of an Fe oxide, a Zn oxide, and an Al oxide. As in the case described above, with respect to the hot-dip galvanized steel sheet, since the surface is inactive, the Fe oxide initially formed becomes nonuniform. A large amount of oxides is also required to achieve a satisfactory effect, resulting in peeling of the oxides.

SUMMARY OF THE INVENTION

It is an object of the present invention to provide a hot-dip galvanized steel sheet in which the sliding friction is small during press forming and which exhibits stable, excellent press formability and a method for producing the same.

In order to achieve the object, the present invention provides a hot-dip galvanized steel sheet, comprising a plating layer consisting essentially a η phase and an oxide layer disposed on a surface of the plating layer, the oxide layer having an average thickness of 10 nm or more. Preferably, the oxide layer has an average thickness of 10 to 200 nm. The oxide layer includes a Zn-based oxide layer having a Zn/Al atomic concentration ratio of more than 1 and an Al-based oxide layer having a Zn/Al atomic concentration ratio of less than 1.

It is preferable that the plating layer has concavities and convexities on the surface, and the Zn-based oxide layer is disposed at least on the concavities.

It is preferable that the Zn-based oxide layer has microirregularities, which has a mean spacing (S) determined based on a roughness curve of 1,000 nm or less and an average roughness (Ra) of 100 nm or less.

Preferably, the Zn-based oxide layer has microirregularities with a network structure including convexities and discontinuous concavities surrounded by the convexities.

Preferably, the Zn-based oxide layer includes an oxide containing Zn and Fe and the Fe concentration defined by the expression Fe/(Zn+Fe) is 1 to 50 atomic percent.

Preferably, the Zn-based oxide layer has an areal rate of 15% or more with respect to the surface of the plating layer.

In the hot-dip galvanized steel sheet of the present invention, preferably, the Zn-based oxide layer has a Zn/Al atomic concentration ratio of 4 or more. In the case when the Zn/Al ratio is 4 or more, more preferably, the following conditions are satisfied.

(A) The Zn-based oxide layer has an areal rate of 70% or more with respect to the surface of the plating layer.

(B) The Zn-based oxide layer is disposed on the concavities of the surface of the plating layer formed by temper rolling, and on the convexities or planar portions other than the convexities.

(C) The Zn-based oxide layer includes an oxide containing Zn and Fe and the Fe concentration ratio defined by the expression Fe/(Zn+Fe) is 1 to 50 atomic percent.

(D) The Zn-based oxide layer has microirregularities with a network structure including convexities and discontinuous concavities surrounded by the convexities.

Also, the present invention provides a hot-dip galvanized steel sheet including a plating layer consisting essentially of a η phase and a Zn-based oxide layer containing Fe disposed on a surface of the plating layer, the Zn-based oxide layer having an Fe atomic ratio of 1 to 50 atomic percent, the Fe atomic ratio being defined as Fe/(Fe+Zn).

Preferably, the Zn-based oxide layer has microirregularities with a network structure including convexities and discontinuous concavities surrounded by the convexities.

Preferably, the Zn-based oxide layer has an areal rate of 15% or more with respect to the surface of the plating layer.

Moreover, the present invention provides a hot-dip galvanized steel sheet including a plating layer consisting essentially of a η phase and a Zn-based oxide layer containing Fe disposed on a surface of the plating layer, the Zn-based oxide layer having microirregularities with a network structure including convexities and discontinuous concavities surrounded by the convexities.

Preferably, the Zn-based oxide layer has a mean spacing (S) determined based on a roughness curve of 10 to 1,000 nm and an average roughness (Ra) of 4 to 100 nm.

Preferably, the Zn-based oxide layer has an areal rate of 70% or more with respect to the surface of the plating layer.

Preferably, the Zn-based oxide layer is disposed on the planar portions of the surface of the plating layer other than the concavities formed by temper rolling. More preferably, in the Zn-based oxide layer disposed on the planar portions, the mean spacing (S) determined based on the roughness curve is 10 to 500 nm and the average roughness (Ra) determined based on the roughness curve is 4 to 100 nm.

Additionally, in the present invention, the "Zn-based oxide" present on the surface of the plating layer may include a Zn-based oxide only, may also include a Zn-based hydroxide, or may include a Zn-based hydroxide only.

Further, the present invention provides a method for producing a hot-dip galvanized steel sheet including a hot-dip galvanization step, a temper rolling step, and an oxidation treatment step. In the hot-dip galvanization step, a steel sheet is hot-dip galvanized to form a hot-dip galvanized layer. In the temper rolling step, the steel sheet provided with the hot-dip galvanized layer is temper-rolled. In the oxidation treatment step, the temper-rolled steel sheet is brought into contact with an acidic solution having a pH buffering effect and retained for 1 to 30 seconds before washing with water to perform oxidation treatment. Preferably, the acidic solution contains 1 to 200 g/l of Fe ions.

Preferably, the method for producing the hot-dip galvanized steel sheet further includes an activation step for activating the surface before or after the temper rolling step. More preferably, the activation step is performed before the temper rolling step. Preferably, the activation step includes bringing the steel sheet into contact with an alkaline solution with a pH of 11 or more at 50° C. or more for 1 second or more. By the activation step, the Al-based oxide content in a surface oxide layer before the oxidation treatment step is controlled so that the Al concentration is less than 20 atomic percent.

Also, the present invention provides a method for producing a hot-dip galvanized steel sheet including a hot-dip galvanization step of hot-dip-galvanizing a steel sheet to form a hot-dip galvanized layer; a temper rolling step of temper-rolling the steel sheet provided with the hot-dip galvanized layer; an oxidation treatment step of oxidizing the temper-rolled steel sheet by bringing the temper-rolled steel sheet into contact with an acidic solution having a pH buffering effect and containing 5 to 200 g/l of Fe ions with a pH of 1 to 3, and retaining the temper-rolled steel sheet in this solution for 1 to 30 seconds before washing with water; and an activation step of activating the surface before or after the temper rolling step.

In another aspect of the present invention, a method for producing a hot-dip galvanized steel sheet includes a hot-dip galvanization step of hot-dip-galvanizing a steel sheet to form a hot-dip galvanized layer; a temper rolling step of temper-rolling the steel sheet provided with the hot-dip galvanized layer; an oxidation treatment step of oxidizing the temper-rolled steel sheet by bringing the temper-rolled steel sheet into contact with an acidic solution having a pH buffering effect with a pH of 1 to 5, and retaining the temper-rolled steel sheet in this solution for 1 to 30 seconds before washing with water; and an activation step of activating the surface before or after the temper rolling step.

EMBODIMENT FOR CARRYING OUT THE INVENTION

Embodiment 1

Figure 1:
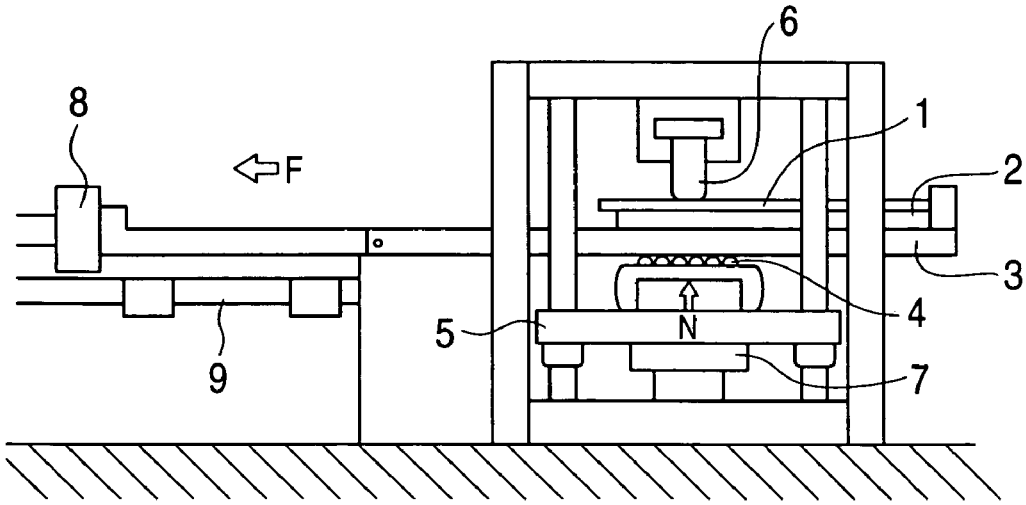
FIG. 1 is an elevation view which schematically shows a friction coefficient measuring device.

The present inventors have found that it is possible to obtain satisfactory press formability under extended sliding conditions by forming a Zn-based oxide along with an inherent Al-based oxide on the surface of a hot-dip galvanized steel sheet.

As described above, since an Al-based oxide layer is formed on the surface of a hot-dip galvanized steel sheet, it is possible to prevent adhesion between the steel sheet and a die during press forming. Therefore, it is believed to be effective in forming a thicker Al-based oxide layer in order to further improve sliding performance during press forming. However, in order to form a thick Al-based oxide layer, the steel sheet must be oxidized at high temperatures for a long period of time, which is practically difficult. During such an oxidation period, an Fe—Zn alloying reaction advances gradually, resulting in degradation in plating adhesion. On the other hand, in order to form a Zn-based oxide layer, the Al-based oxide layer on the surface must be removed completely, and it takes a long time to perform such treatment.

If the Al-based oxide layer is partially broken down to expose a new surface and surface oxidation treatment is performed, a Zn-based oxide is formed on the newly exposed surface, and it is also possible to apply a Zn-based oxide layer to the newly exposed surface. In the oxide layer thus formed on the surface of the plating layer, both the Zn-based oxide and the Al-based oxide are present, and thereby adhesion to the press die is further prevented. Consequently, it is possible to obtain satisfactory press formability under the extended sliding conditions. It has also been found that by forming such a Zn-based oxide layer at least on the concavities in the irregularities formed on the surface of the plating layer, sliding friction can be reduced.

In the oxidation treatment, by immersing the hot-dip galvanized steel sheet in an acidic solution so as to form an acidic solution film on the surface of the steel sheet and then by allowing it to stand for a predetermined time, it is possible to form the Zn-based oxide effectively. Additionally, after temper rolling is performed, by bringing the steel sheet into contact with an alkaline solution so as to partially break down and dissolve the Al-based oxide layer, the oxide layer can be more effectively formed.

The present inventors have also found that by forming microirregularities in the Zn-based oxide disposed on the surface of the plating layer, sliding performance can be further improved. The microirregularities are defined by a surface roughness in which the average roughness Ra (hereinafter also referred to simply as "Ra") determined based on the roughness curve is 100 nm or less and the mean spacing S (hereinafter also referred to simply as "S") of local irregularities determined based on the roughness curve is 1,000 nm or less. This surface roughness is one or more orders of magnitude smaller than the surface roughness (Ra: about 1 μm) described in the Patent Literature 1 or 2. Accordingly, the surface roughness parameters, such as Ra, in the present invention are calculated based on the roughness curve with a length of several microns, and are different from the general surface roughness parameters which define irregularities of the micron (μm) order or more determined based on the roughness curve with a length of the millimeter order or more. In the related literatures, the surface roughness of the hot-dip galvanized steel sheet is defined, while in the present invention, the surface roughness of the oxide layer applied to the surface of the hot-dip galvanized steel sheet is defined.

The present inventors have also found that in order to form microirregularities in the Zn-based oxide, it is effective to incorporate Fe into the Zn-based oxide. In the method in which the acidic solution film is formed on the surface of the steel sheet and then the steel sheet is allowed to stand for a predetermined time so that the Zn-based oxide is added to the hot-dip galvanized steel sheet, by incorporating Fe into the acidic solution, the Zn-based oxide containing Zn and Fe is formed, and thereby microirregularities can be effectively formed in the oxide.

Since the hot-dip galvanized steel sheet is usually produced by dipping a steel sheet in a zinc bath containing a very small amount of Al, the plating layer is substantially composed of the η phase, and the Al-based oxide layer resulting from Al contained in the zinc bath is formed on the surface. The η phase is softer than the ξ phase or the δ phase which is the alloy phase of the hot-dip galvannealed steel sheet, and the melting point of the η phase is lower. Consequently, adhesion is likely to occur and sliding performance is poor during press forming. However, in the case of the hot-dip galvanized steel sheet, since the Al-based oxide layer is formed on the surface, an effect of preventing adhesion to the die is slightly exhibited. In particular, when the hot-dip galvanized steel sheet slides over a die and when the sliding distance is short, degradation in the sliding performance may not occur. However, since the Al-based oxide layer formed on the surface is thin, as the sliding distance is increased, adhesion becomes likely to occur, and it is not possible to obtain satisfactory press formability under the extended sliding conditions.

In order to prevent adhesion between the hot-dip galvanized steel sheet and the die, it is effective to form a thick oxide layer on the surface of the steel sheet. Consequently, it is effective in improving the sliding performance of the hot-dip galvanized steel sheet to form the oxide layer including both the Zn-based oxide and the Al-based oxide by partially breaking down the Al-based oxide layer on the surface of the plating layer and forming the Zn oxide-based layer by oxidation.

Although the reason for the above is not clear, the sliding performance is assumed to improve due to the mechanism described below. That is, in the regions in which the Al-based oxide layer on the plating layer is partially broken down and a new surface is exposed, the reactivity is increased, and the Zn-based oxide can be easily generated. In contrast, the region in which the Al-based oxide layer remains is inactive, and the oxidation does not advance. In the region in which the Zn-based oxide is formed, since the thickness of the oxide layer can be easily controlled, it is possible to obtain the thickness of the oxide layer required for improving the sliding performance. During actual press forming, the die is brought into contact with the oxide layer including the Zn-based oxide and the Al-based oxide. Even if the Al-based oxide layer is scraped away to cause a state in which adhesion easily occurs, since the Zn-based oxide layer can exhibit the adhesion-preventing effect, it is possible to improve the press formability.

When the thickness of the oxide layer is controlled, if a large thickness is attempted to be obtained, the thickness of the region in which the Zn-based oxide is present becomes large and the thickness of the region in which the Al-based oxide layer remains does not become large. Consequently, an oxide layer with a nonuniform thickness in which thick regions and thin regions are present is formed over the entire surface of the plating layer. However, because of the same mechanism as that described above, it is possible to improve the sliding performance. In addition, even if the thin regions partially do not include the oxide layer for some reason, it is possible to improve the sliding performance because of the same mechanism.

By setting the average thickness of the oxide layer at 10 nm or more, satisfactory sliding performance can be obtained. To set the average thickness of the oxide layer at 20 nm or more is more effective. The reason for this is that in press working in which the contact area between the die and the workpiece is large, even if the surface region of the oxide layer is worn away, the oxide layer remains, and thus the sliding performance is not degraded. On the other hand, although there is no upper limit for the average thickness of the oxide layer in view of the sliding performance, if a thick oxide layer is formed, the reactivity of the surface is extremely decreased, and it becomes difficult to form a chemical conversion coating. Therefore, the average thickness of the oxide layer is desirably 200 nm or less.

Additionally, the average thickness of the oxide layer can be determined by Auger electron spectroscopy (AES) combined with Ar ion sputtering. In this method, after sputtering is performed to a predetermined depth, the composition at the depth is determined based on the correction of the spectral intensities of the individual elements to be measured using relative sensitivity factors. The O content resulting from oxides reaches the maximum value at a certain depth (which may be the outermost layer), then decreases, and becomes constant. The thickness of the oxide is defined as a depth that corresponds to a half of the sum of the maximum value and the constant value at a position deeper than the maximum value.

It is also possible to check the presence or absence of an oxide layer with nonuniform thickness based on the measurement results of Auger electron spectroscopy (AES). This is based on the fact that the thick regions are primarily composed of the Zn-based oxide and the thin regions are composed of the Al-based oxide. The thickness can be evaluated based on the Zn/Al ratio (atomic ratio) at the surface layer. That is, the regions with a Zn/Al ratio exceeding 1.0 correspond to thick regions, and the regions with a Zn/Al ratio of 1.0 or less correspond to thin regions. By performing analysis at given points, and if the Zn/Al ratio at any one point is 1.0 or less, the formation of an oxide layer with a nonuniform thickness can be confirmed. The presence ratio between the thick regions and the thin regions is not particularly limited. If the area occupied by the thin regions is large, the average thickness of the oxide layer is less than 10 nm, and the effect of improving the sliding performance is not obtained. If the average thickness is within the range of the present invention, satisfactory characteristics can be obtained.

The shape of the region in which the Zn-based oxide is present is not particularly limited. It has been found that by forming irregularities in the surface of the plating layer and by allowing the Zn-based oxide to be present at least on the concavities, the sliding friction can be reduced satisfactorily. The concavities of the surface of the plating layer, which are different from the concavities of the microirregularities of the Zn-based oxide region, correspond to macroirregularities, for example, with such a size that the diameter is about several to 100 micrometers when the concavity is transposed into a circle with the same area.

The reason for the reduction in the sliding friction is thought to be as follows. As described above, since the Al-based oxide layer is present on the surface of the plating layer of the hot-dip galvanized steel sheet, if the sliding distance is short, the sliding friction is relatively small. As the sliding distance increases, the sliding friction increases. Under the long sliding conditions, in the case of the hot-dip galvanized steel sheet including the plating layer substantially composed of the η phase which is softer and more easily deformed compared with the cold rolled steel sheet or the hot-dip galvannealed steel sheet, not only the convexities but also most of the concavities of the surface are worn out and the sliding area is greatly increased, resulting in an increase in the sliding friction. By forming the Zn-based oxide which is highly effective in reducing sliding friction on the concavities of the surface of the plating layer, it is possible to prevent the sliding area from being increased, resulting in a reduction in the increase of sliding friction under the long sliding conditions.

The thickness distribution of the oxide layer can be directly observed with a scanning electron microscope using an electron beam at an accelerating voltage of 1 kV or less (refer to Nonpatent Literature 1: Masayasu Nagoshi and two others, "Actual material surface observed with ultra-low voltage scanning electron microscope", Hyomen Gijutsu (Journal of the Surface Finishing Society of Japan) 2003, 54 (1), 31-34).

In accordance with this method, it is possible to obtain a secondary electron image in which the thick regions and the thin regions of the oxide layer can be easily distinguished. The presence ratio of both can be calculated by processing the image, etc. As a result of evaluation of the presence ratio of the thick regions of the oxide applied to the hot-dip galvanized steel sheet using the method, it has been found that if the thick regions of the oxide have an areal rate of at least 15% with respect to the surface of the plating layer, the sliding friction is reduced. There is no upper limit for the presence ratio of the thick regions of the oxide regarding the sliding friction reducing effect.

In order to form such an oxide layer, a method is effective in which a hot-dip galvanized steel sheet is brought into contact with an acidic solution having a pH buffering effect, allowed to stand for 1 to 30 seconds, and then washed with water, followed by drying.

Although the mechanism of the formation of the oxide layer is not clear, it is thought to be as follows. When the hot-dip galvanized steel sheet is brought into contact with the acidic solution, zinc on the surface of the steel sheet starts to be dissolved. When zinc is dissolved, hydrogen is also generated. Consequently, as the dissolution of zinc advances, the hydrogen ion concentration in the solution decreases, resulting in an increase in the pH of the solution. A Zn-based oxide layer is thereby formed on the surface of the hot-dip galvanized steel sheet. As described above, in order to form the Zn-based oxide, zinc must be dissolved and the pH of the solution in contact with the steel sheet must be increased. Therefore, it is effective to adjust the retention time after the steel sheet is brought into contact with the acidic solution until washing with water is performed. If the retention time is less than one second, the liquid is washed away before the pH of the solution with which the steel sheet is in contact is increased. Consequently, it is not possible to form the oxide. On the other hand, even if the steel sheet is allowed to stand for 30 seconds or more, there is no change in the formation of the oxide.

The acidic solution used for such oxidation preferably has a pH of 1.0 to 5.0. If the pH exceeds 5.0, the dissolution rate of zinc is decreased. If the pH is less than 1.0, the dissolution of zinc is excessively accelerated. In either case, the formation rate of the oxide is decreased. Preferably, a chemical solution having a pH buffering effect is added to the acidic solution. By using such a chemical solution, pH stability is imparted to the treatment liquid during the actual production and the increase in the pH required for generating the oxide is also activated, and thereby a thick oxide layer is efficiently formed.

Any chemical solution which has a pH buffering effect in the acidic range may be used. Examples thereof include acetates, such as sodium acetate ($CH_3COONa$); phthalates, such as potassium hydrogen phthalate ($(KOOC)_2C_6H_4$); citrates, such as sodium citrate ($Na_3C_6H_5O_7$) and potassium dihydrogen citrate ($KH_2C_6H_5O_7$); succinates, such as sodium succinate ($Na_2C_4H_4O_4$); lactates, such as sodium lactate ($NaCH_3CHOHCO_2$); tartrates, such as sodium tartrate ($Na_2C_4H_4O_6$); borates; and phosphates. These may be used alone or in combination of two or more.

The concentration of the chemical solution is preferably 5 to 50 g/l. If the concentration is less than 5 g/l, the pH buffering effect is insufficient, and it is not possible to form a desired oxide layer. If the concentration exceeds 50 g/l, the effect is saturated, and it also takes a long time to form the oxide. By bringing the galvanized steel sheet into contact with the acidic solution, Zn from the plating layer is dissolved in the acidic solution, which does not substantially prevent the formation of the Zn oxide. Therefore, the Zn concentration in the acidic solution is not specifically defined.

The method for bringing the galvanized steel sheet into contact with the acidic solution is not particularly limited. For example, a method in which the galvanized steel sheet is immersed in the acidic solution, a method in which the acidic solution is sprayed to the galvanized steel sheet, or a method in which the acidic solution is applied to the galvanized steel sheet using an application roller may be employed. Desirably, the acidic solution is applied so as to be present in a thin liquid film form on the surface of the steel sheet. If the amount of the acidic solution present on the surface of the steel sheet is large, even if zinc is dissolved, the pH of the solution is not increased, and only the dissolution of zinc occurs continuously. Consequently, it takes a long time to form the oxide layer, and the plating layer is greatly damaged. The original rust-preventing function of the steel sheet may be lost. From this viewpoint, the amount of the liquid film is preferably adjusted to 3 $g/m^2$ or less. The amount of the liquid film can be adjusted by squeeze rolling, air wiping, or the like.

The hot-dip galvanized steel sheet must be temper-rolled before the process of forming the oxide layer. The temper rolling operation is usually performed primarily in order to adjust the material quality. In the present invention, the temper rolling operation is also performed to partially break down the Al-based oxide layer present on the surface of the steel sheet.

The present inventors have observed the surface of the galvanized steel sheet before and after the formation of the oxide using a scanning electron microscope and found that the Zn-based oxide is mainly formed in the regions in which the Al-based oxide layer is broken down by the convexities of fine irregularities of the surface of the roller when the roller is brought into contact with the surface of the plating layer during temper rolling. Consequently, by controlling the roughness of the surface of the roller for temper rolling and elongation during temper rolling, the area of the broken down Al-based oxide layer can be controlled, and thereby the areal rate and distribution of the Zn-based oxide layer can be controlled. Additionally, concavities can also be formed on the surface of the plating layer by such a temper rolling operation.

The example in which temper rolling is performed has been described above. Any other techniques which can mechanically break down the Al-based oxide layer on the surface of the plating layer may be effective in forming the Zn-based oxide and controlling the areal rate. Examples thereof include processing using a metallic brush and shot blasting.

It is also effective to perform activation treatment after the temper rolling step and before the oxidation step, in which the steel sheet is brought into contact with an alkaline solution to activate the surface. This treatment is performed to further remove the Al-based oxide and to expose a new surface. In the temper rolling step described above, there may be a case in which the Al-based oxide layer is not broken down sufficiently depending on the type of the steel sheet because of the elongation restricted by the material. Therefore, in order to stably form an oxide layer having excellent sliding performance regardless of the type of the steel sheet, it is necessary to activate the surface by further removing the Al-based oxide layer.

The method used in order to bring the steel sheet into contact with the alkaline solution is not particularly limited, and immersion or spraying may be used. Any alkaline solution enables the activation of the surface. If the pH is low, the reaction is slow and it takes a long time to complete the process. Consequently, the alkaline solution preferably has a pH of 10 or more. Any type of alkaline solution having the pH in the above range may be used. For example, sodium hydroxide may be used.

The shape of the Zn-based oxide formed on the surface of the plating layer has not been described above. By forming microirregularities in the Zn-based oxide, sliding friction can be further reduced. The microirregularities are defined by a surface roughness in which the average roughness (Ra) determined based on the roughness curve is 100 nm or less and the mean spacing (S) of local irregularities determined based on the roughness curve is 1,000 nm or less.

The sliding friction is reduced by the microirregularities because the concavities of the microirregularities are believed to function as a group of fine oil pits so that a lubricant can be effectively caught therein. That is, in addition to the sliding friction reducing effect as the oxide, a further sliding friction reducing effect is believed to be exhibited because of the fine sump effect in which the lubricant is effectively retained in the sliding section. Such a lubricant-retaining effect of the microirregularities is particularly effective in stably reducing the sliding friction of the hot-dip galvanized layer which has a relatively smooth surface macroscopically, in which a lubricant is not easily retained macroscopically, and on which it is difficult to stably form a macroscopic surface roughness by rolling or the like in order to achieve lubricity. The lubricant-retaining effect of the microirregularities is particularly effective under the sliding conditions in which the contact surface pressure is low.

With respect to the structure of the microirregularities, for example, the surface of the Zn-based oxide layer may have microirregularities. Alternatively, a Zn-based oxide in a granular, tabular, or scaly shape may be distributed directly on the surface of the plating layer or on the oxide layer and/or hydroxide layer. Desirably, the microirregularities have Ra of 100 nm or less and S of 800 nm or less. Even if Ra and S are increased from the above upper limits, the lubricant-retaining effect is not substantially improved, and it becomes necessary to apply the oxide thickly, resulting in a difficulty in production. Although the lower limits of the parameters are not particularly defined, it has been confirmed that the sliding friction-reducing effect is exhibited at Ra of 3 nm or more and S of 50 nm or more. More preferably, Ra is 4 nm or more. If the microirregularities become too small, the surface becomes close to a smooth surface, resulting in a reduction in the viscous oil-retaining effect, which is not advantageous.

One of the methods effective in controlling Ra and S is to incorporate Fe into the Zn-based oxide as will be described below. If Fe is incorporated into the Zn-based oxide, the Zn oxide gradually becomes finer and the number of pieces increases. By controlling the Fe content and the growth time, it is possible to adjust the size and distribution of the Zn oxide, and thereby Ra and S can be adjusted. This is not restricted by the shape of the microirregularities.

The surface roughness parameters, i.e., Ra and S, can be calculated according to the formulae described in Japan Industrial Standard B-0660-1998 "Surface roughness—Terms", etc., based on the roughness curve with a length of several microns extracted from the digitized surface shape of the Zn-based oxide using a scanning electron microscope or scanning probe microscope (such as an atomic force microscope) having three-dimensional shape measuring function. The shape of the microirregularities can be observed using a high-resolution scanning electron microscope. Since the thickness of the oxide is small at about several tens of nanometers, it is effective to observe the surface at a low accelerating voltage, for example, at 1 kV or less. In particular, if the secondary electron image is observed by excluding secondary electrons with low energy of about several electron volts as electron energy, it is possible to reduce contrast caused by the electrostatic charge of the oxide. Consequently, the shape of the microirregularities can be observed satisfactorily (refer to Nonpatent Literature 1).

The method for forming the microirregularities in the Zn-based oxide is not particularly limited. One of the effective methods is to incorporate Fe into the Zn-based oxide. By incorporating Fe into the Zn-based oxide, the size of the Zn-based oxide can be miniaturized. An aggregate of the miniaturized oxide pieces makes microirregularities. Although the reason why the oxide containing Zn and Fe is formed into an oxide having microirregularities is not clear, it is assumed that the growth of the Zn oxide is inhibited by Fe or the oxide of Fe. Although the preferable ratio (percent) of Fe to the sum of Zn and Fe is not clarified, the present inventors have confirmed that the Fe content of at least 1 to 50 atomic percent is effective.

Such an oxide containing Zn and Fe is formed by incorporating Fe into the acidic solution in the method in which the hot-dip galvanized steel sheet is brought into contact with the acidic solution having the pH buffering effect described above. Although the concentration is not particularly limited, for example, addition of ferrous sulfate (heptahydrate) in the range of 5 to 400 g/l with the other conditions being the same as those described above enables the formation.

When the hot-dip galvanized steel sheet of the present invention is produced, Al must be incorporated into the plating bath. The additive elements other than Al are not particularly limited. That is, the advantage of the present invention is not degraded even if Pb, Sb, Si, Sn, Mg, Mn, Ni, Ti, Li, Cu, or the like is incorporated besides Al.

The advantage of the present invention is also not degraded even if a very small amount of P, S, N, B, Cl, Na, Mn, Ca, Mg, Ba, Sr, Si, or the like is incorporated into the oxide layer due to the inclusion of impurities during oxidation.

EXAMPLE 1

A hot-dip galvanized layer was formed on a cold-rolled steel sheet with a thickness of 0.8 mm, and then temper rolling was performed. The steel sheet was then immersed in an aqueous sodium acetate solution (20 g/l) with pH of 2.0 at 50° C., allowed to stand for a while, and was washed with water, followed by drying. Thereby, an oxide layer was formed on the surface of the plating layer. Twelve samples were thus prepared. The average thickness of the oxide layer was adjusted by changing the retention time. Some of the samples were immersed in an aqueous sodium hydroxide solution with pH of 12 before the oxidation step.

With respect to each sample, a press formability test was performed and the thickness of the oxide layer was measured. The press formability test and the measurement of the oxide layer were performed as follows.

(1) Press Formability Test (Coefficient of Friction Measurement Test)

In order to evaluate the press formability, the coefficient of friction of each sample was measured as follows. FIG. 1 is an elevation view which schematically shows a friction coefficient measuring device. As shown in the drawing, a test piece 1, which is collected from the sample, for coefficient of friction measurement is fixed on a stage 2, and the stage 2 is fixed on the upper surface of a horizontally movable slide table 3. A vertically movable slide table support 5 including a roller 4 in contact with the lower surface of the slide table 3 is provided below the slide table 3. A first load cell 7 which measures a pressing load N of a bead 6 to the test piece 1 is mounted on the slide table support 5. A second load cell 8 which measures a sliding friction F for horizontally moving the slide table 3 with the pressing force being applied is mounted on one end of the slide table 3. Additionally, as a lubricant, cleaning oil for pressing (Preton R352L manufactured by Sugimura Chemical Industrial Co., Ltd.) was applied on the surface of the test piece 1 when testing was performed.

Figure 2:
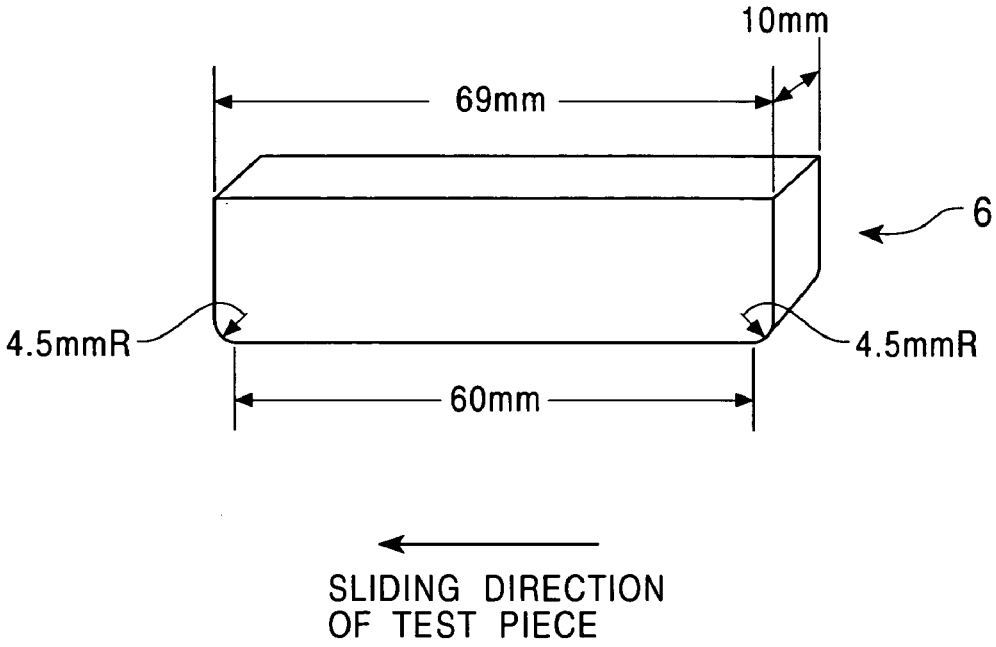
FIG. 2 is a perspective view which schematically shows the shape and dimension of a bead shown in FIG. 1.

FIG. 2 is a perspective view which schematically shows the shape and dimension of the bead used. Sliding was performed with the lower surface of the bead 6 being pressed against the surface of the test piece 1. In the bead 6 shown in FIG. 2, the width is 10 mm, the length in the sliding direction of the test piece is 69 mm, and each edge in the sliding direction of the lower surface of the bead 6 is curved with a curvature of 4.5 mmR. The lower surface of the bead 6 against which the test piece is pressed has a plane with a width of 10 mm and a length in the sliding direction of 60 mm. By using this bead, the coefficient of friction under the condition of a long sliding distance can be evaluated. In the coefficient of friction measurement test, the pressing load N was set at 400 kgf and the drawing speed of the test piece (the horizontal movement speed of the slide table 3) was set at 20 cm/min.

The coefficient of friction between the test piece and the bead was calculated based,on the equation $\mu=F/N$.

(2) Measurement of Oxide Layer

The contents (atomic percent) of the individual elements were measured by Auger electron spectoroscopy (AES), and after Ar sputtering was performed to a predetermined depth, the contents of the individual elements in the plating layer were measured. By repeating this, the distribution of each element in the depth direction was measured. The O content resulting from oxides and hydroxides reaches the maximum value at a certain depth, then decreases, and becomes constant. The thickness of the oxide was defined as a depth that corresponded to a half of the sum of the maximum value and the constant value at a position deeper than the maximum value. The average of the thicknesses of the oxide measured at 5 given points was defined as the average thickness of the oxide layer. Additionally, as a preliminary treatment, the contaminated layer on the surface of each sample was removed by performing Ar sputtering for 30 seconds.

When the distributions of the individual elements in the depth direction at given points were measured, it was found that regions in which the Zn/Al ratio at the surface layer exceeded 1 and regions in which the Zn/Al ratio was 1 or less were mixed. As a result of checking the thicknesses of the oxide layers, it was found that the region with a Zn/Al ratio exceeding 1 (region primarily composed of the Zn-based oxide) had a larger thickness of the oxide layer compared with the region with a Zn/Al ratio of 1 or less (region primarily composed of the Al-based oxide). Consequently, the average of these regions was defined as the average thickness of the oxide layer.

The test results are shown in Table 1.

TABLE 1

| Sample No. | Alkaline treatment | Immersion in acidic solution | Retention time until water washing (sec) | Average thickness of oxide layer (nm) | Coefficient of friction | Remarks |
|---|---|---|---|---|---|---|
| 1 | — | — | — | 6.5 | 0.280 | CE 1 |
| 2 | — | ○ | 0.0 | 8.8 | 0.268 | CE 2 |
| 3 | — | ○ | 1.0 | 11.8 | 0.230 | EP 1 |
| 4 | — | ○ | 5.0 | 14.5 | 0.225 | EP 2 |
| 5 | — | ○ | 10.0 | 18.6 | 0.218 | EP 3 |
| 6 | — | ○ | 20.0 | 20.3 | 0.211 | EP 4 |
| 7 | — | ○ | 30.0 | 22.4 | 0.203 | EP 5 |
| 8 | ○ | ○ | 1.0 | 21.5 | 0.209 | EP 6 |
| 9 | ○ | ○ | 5.0 | 25.6 | 0.198 | EP 7 |
| 10 | ○ | ○ | 10.0 | 30.1 | 0.193 | EP 8 |
| 11 | ○ | ○ | 20.0 | 32.7 | 0.189 | EP 9 |
| 12 | ○ | ○ | 30.0 | 35.5 | 0.185 | EP 10 |

○: Performed
CE: Comparative Example
EP: Example of Present Invention

The followings are evident from the test results shown in Table 1.

(1) Since Sample No. 1 is not subjected to oxidation treatment after temper rolling, the coefficient of friction is high.

(2) Although Sample No. 2 is subjected to oxidation treatment after temper rolling, the retention time until water washing is not within the range of the present invention. Consequently, the average thickness of the oxide layer on the surface of the plating layer is not within the range of the present invention. The coefficient of friction is lower than that of Sample No. 1, but is insufficient.

(3) With respect to each of Sample Nos. 3 to 7, oxidation treatment is performed after temper rolling and the retention time until water washing is within the range of the present invention. Consequently, the average thickness of the oxide layer on the surface of the plating layer is within the range of the present invention, and the coefficient of friction is low.

(4) With respect to each of Sample Nos. 8 to 12, immersion in the alkaline solution is performed before oxidation treatment. The coefficient of friction is lower compared with each of Sample Nos. 3 to 7 with the same retention time until water washing.

EXAMPLE 2

A hot-dip galvanized layer with a Zn coating weight of 60 g/m$^2$ was formed on a cold-rolled steel sheet with a thickness of 0.8 mm, and then temper rolling was performed with respect to seven samples. Two types of temper rolling were performed. In temper rolling Type X, rolling was performing using a discharge dull roller with a roughness Ra of 3.4 μm so that the elongation was 0.8%. In temper rolling Type Y, rolling was performed using a roller with a roughness Ra of 1.4 μm and using a shot blasting technique so that the elongation was 0.7%. Additionally, in temper rolling type Y, with respect to the steel sheet on which oxidation treatment was not performed, the contact area rate of the roller was evaluated to be about 20% using a scanning electron microscope at an accelerating voltage of 0.5 to 2 kV. The contact area rate of the roller was determined by measuring the area of the region with which the roller was brought into contact based on a secondary electron image of the scanning electron microscope. The surface of the plating layer with which the roller was not brought into contact was very smooth, while in the region with which the roller was brought into contact, the surface was roughened and not smooth. Based on this fact, both can be easily distinguished.

The steel sheet was then immersed in an aqueous sodium acetate solution (40 g/l) with a pH of 1.7 at the working temperature for 3 seconds, allowed to stand for 5 seconds, and was washed with water, followed by drying. Thereby, an oxide layer was formed on the surface of the plating layer (treatment liquid A). At this stage, with respect to some of the samples, the same treatment was performed using, instead of the above treatment liquid, an aqueous sodium acetate solution (40 g/l) with pH of 2.0 to which ferrous sulfate (heptahydrate) was added. A treatment liquid B, a treatment liquid C, and a treatment liquid D with a ferrous sulfate (heptahydrate) content of 5 g/l, 40 g/l, and 450 g/l, respectively, were used. The temperature of the treatment liquids A, B, and C was 30° C., and the temperature of the treatment liquid D was 20° C. Some of the samples were immersed in an aqueous sodium hydroxide solution with a pH of 12 before the above treatment.

With respect to each sample, a press formability test, measurement of the average thickness of the oxide layer, evaluation of the composition of the Zn-based oxide layer, measurement of the areal rate of the region in which the Zn-based oxide was formed, observation of the microirregularities of the Zn-based oxide, and measurement of the surface roughness of the Zn-based oxide were performed.

The press formability test and the measurement of the oxide layer were performed as in Example 1. When the thickness of the oxide layer was evaluated using Auger electron spectroscopy, the composition of the Zn-based oxide layer was evaluated by qualitative analysis. Additionally, the press formability test in Example 1 was also used to evaluate the coefficient of friction under the sliding conditions of a low contact area pressure.

In order to measure the areal rate of the region in which the Zn-based oxide was formed, a scanning electron microscope (LEO1530 manufactured by LEO Company) was used, and a secondary electron image at a low magnification was observed at an accelerating voltage of 0.5 kV with an in-lens secondary electron detector. Under these observation conditions, the region in which the Zn-based oxide was formed was clearly distinguished as dark contrast from the region in which such an oxide was not formed. The resultant secondary electron image was binarized by an image processing software, and the areal rate of the dark region was calculated to determine the areal rate of the region in which Zn-based oxide was formed.

3 μm in the scanning direction of the electron beam were extracted. At least three locations were measured for each sample.

Based on the roughness curves, using an analysis software attached to the apparatus, the average surface roughness (Ra) of the roughness curves and the mean spacing (S) of local irregularities of the roughness curves were calculated. Herein, Ra and S are parameters for evaluating the roughness of the microirregularities and the period, respectively. The general definitions of these parameters are described in Japan Industrial Standard B-0660-1998 "Surface roughness—Terms", etc. In the present invention, the roughness parameters are based on roughness curves with a length of several micrometers, and Ra and S are calculated according to the formulae defined in the literature described above.

When the surface of the sample is irradiated with an electron beam, contamination primarily composed of carbon may grow and appear in the measurement data. Such an influence is likely to become remarkable when the region measured is small as in this case. Therefore, when the data was analyzed, this influence was eliminated using a Spline hyper filter with a cut-off wavelength corresponding to a half of the length in the measurement direction (about 3 μm). In order to calibrate the apparatus, SHS Thin Step Height Standard (Steps 18 nm, 88 nm, and 450 nm) manufactured by VLSI standards Inc. traceable to the U.S. national research institute NIST was used.

The results are shown in Table 2.

TABLE 2

| Sample No. | Alkaline treatment | Immersion in acidic solution | Temper rolling type | Average thickness of oxide layer (nm) | Composition of film applied* | Ra (nm) of Zn-based oxide | S (nm) of Zn-based oxide | Areal rate (%) of Zn-based oxide | Coefficient of friction | Remarks |
|---|---|---|---|---|---|---|---|---|---|---|
| 1 | — | — | X | 7.2 | — | — | — | — | 0.288 | CE 1 |
| 2 | — | — | Y | 5.9 | — | — | — | — | 0.331 | CE 2 |
| A-1 | ○ | A | X | 27.2 | Zn—O | 92 | 720 | 95 | 0.185 | EP 1 |
| A-2 | | | | 29.5 | Zn—O | 64 | 560 | 91 | 0.188 | EP 2 |
| B-1 | | B | | 25.3 | Zn—Fe—O | 48 | 470 | 89 | 0.168 | EP 3 |
| B-2 | | | | 24.6 | Zn—Fe—O | 33 | 350 | 85 | 0.172 | EP 4 |
| C-1 | — | C | Y | 10.8 | Zn—Fe—O | 5.6 | 110 | 19 | 0.201 | EP 5 |
| C-2 | | | | 11.7 | Zn—Fe—O | 4.5 | 80 | 21 | 0.207 | EP 6 |
| D | — | D | Y | 12.6 | Zn—Fe—O | 3.1 | 100 | 24 | 0.229 | EP 7 |

*Main elements detected by Auger electron spectroscopy
○: Performed
CE: Comparative Example
EP: Example of Present Invention The formation of the microirregularities of the Zn-based oxide was confirmed by a method in which, using a scanning electron microscope (LEO1530 manufactured by LEO Company), a secondary electron image at a high magnification was observed with an Everhart-Thornly secondary electron detector placed in a sample chamber at an accelerating voltage of 0.5 kV.

In order to measure the surface roughness of the Zn-based oxide, a three dimensional electron probe surface roughness analyzer (ERA-8800FE manufactured by Elionix Inc.) was used. The measurement was performed at an accelerating voltage of 5 kV and a working distance of 15 mm. Sampling distance in the in-plane direction was set at 5 nm or less (at an observation magnification of 40,000 or more). Additionally, in order to prevent electrostatic charge build-up due to the electron beam irradiation, gold vapor deposition was performed. For each region in which the Zn-based oxide was present, 450 or more roughness curves with a length of about (1) In Examples 1 to 7 of the present invention, Auger electron spectroscopy confirms the presence of the Zn-based oxide and the Al-based oxide on the surface of the plating layer. In Examples 1 to 7 of the present invention, the coefficient of friction is lower compared with Comparative Example 1 or 2 in which oxidation treatment is not performed, and thereby the sliding friction is reduced. As is evident from this result, excellent press formability is exhibited.

(2) In Examples 1 to 6 of the present invention, microirregularities are clearly observed in the region in which the Zn-based oxide is present by a scanning electron microscope. On the other hand, in Example 7 of the present invention, although slight protrusions are present, the surface is smoother compared with Examples 1 to 6 of the present invention. In Examples 1 to 6 of the present invention, Ra is 4 μm or more, and in Example 7 of the present invention, Ra is 3.1 nm. When microirregularities are present in the region in which the Zn-based oxide is present and Ra is 4 μm or more, the coefficient of friction is lower and the sliding friction is further reduced. As is evident from this result, excellent press formability is exhibited.

(3) In Examples 3 to 6 of the present invention in which microirregularities are present, the samples are produced using acidic solutions in which Fe is incorporated, and the oxide layers are composed of oxides containing Zn and Fe. As in these examples, by using an acidic solution in which Fe is properly incorporated, the size of the microirregularities can be controlled, and it is possible to form an oxide containing Zn and Fe with microirregularities having an effect of greatly reducing sliding friction.

(4) In all of the examples of the present invention, since the areal rate of the region in which the Zn-based oxide is present is 15% or more, an excellent sliding friction reducing effect is exhibited.

(5) In Examples 5 to 7 of the present invention, most of the Zn-based oxides are present on the concavities of the plating layers formed by temper rolling. In these examples, the coefficient of friction is lower compared with Comparative Example 2 in which the same type of temper rolling is performed, i.e., similar concavities are present on the surface of the plating layer. As is evident from this result, the Zn-based oxide formed on the concavities of the surface of the plating layer has a sliding friction-reducing effect.

Embodiment 2

The sliding performance of a hot-dip galvanized steel sheet greatly depends on the surface pressure during sliding because the plating layer is soft unlike a hot-dip galvannealed steel sheet. It has been found that the sliding performance is satisfactory if the surface pressure is high and that the sliding performance is degraded if the surface pressure is decreased. Under the conditions of low surface pressure, since the deformation of the surface of the plating layer is small, convexities are mainly brought into contact with a die. It has been found that an oxide layer must be formed also on the convexities in order to further improve the sliding performance of the hot-dip galvanized steel sheet under the low surface pressure conditions.

The surface of the hot-dip galvanized steel sheet is planar before temper rolling is performed. The irregularities of the roller are transferred to the surface of the plating layer of the hot-dip galvanized steel sheet by rolling. The concavities of the surface of the plating layer are more active compared with the convexities because the Al-based oxide is mechanically broken down. On the other hand, the convexities are substantially not deformed by the rolling operation and are generally maintained to be planar. The Al-based oxide on the convexities of the surface of the plating layer are not substantially broken down. Accordingly, the surface of the hot-dip galvanized steel sheet after temper rolling includes active and inactive portions nonuniformly.

If such a surface is subjected to oxidation treatment, it is possible to form the Zn-based oxide on the concavities. However, the oxide is formed only on the concavities, and it is difficult to apply the oxide on the planar portions corresponding to the convexities other than the concavities.

The present inventors have also found that by forming microirregularities in the Zn-based oxide disposed on the surface of the plating layer, sliding performance can be further improved. The microirregularities are defined by a surface roughness in which the average roughness Ra determined based on the roughness curve is 100 nm or less and the mean spacing S of local irregularities determined based on the roughness curve is 1,000 nm or less. This surface roughness is one or more orders of magnitude smaller than the surface roughness (Ra: about 1 μm) described in the Patent Literature 1 or 2. Accordingly, the surface roughness parameters, such as Ra, in the present invention are calculated based on the roughness curve with a length of several microns, and are different from the general surface roughness parameters which define irregularities of the micron (μm) order or more determined based on the roughness curve with a length of the millimeter order or more. In the related literatures, the surface roughness of the hot-dip galvanized steel sheet is defined, while in the present invention, the surface roughness of the oxide layer applied to the surface of the hot-dip galvanized steel sheet is defined.

It is not possible to form such microirregularities simply by bringing a hot-dip galvanized steel sheet into contact with an acidic solution, followed by drying. It is possible to form such microirregularities by bringing a hot-dip galvanized steel sheet into contact with an acidic solution having a pH buffering effect defined in the present invention, and by retaining the steel sheet in this solution for 1 to 30 seconds before water washing because of the mechanism which will be described below. The retention time until water washing is important, and the retention time is more preferably 3 to 10 seconds.

If the oxidation treatment is performed after temper rolling, the oxide having microirregularities is preferentially formed on the concavities of the plating layer formed by the roller. However, it is difficult to form the oxide having microirregularities on the convexities or the planar portions which are not influenced by the roller. Under the circumstances, the present inventors have found that it is effective to decrease the amount of the Al-based oxide on the surface to a proper amount by performing activation treatment before the oxidation treatment. Consequently, it is possible to form the oxide having microirregularities which are effective for sliding performance over most of the surface of the plating layer, and thereby sliding performance at low surface pressures can be greatly improved.

The Al-based oxide on the surface of the hot-dip galvanized steel sheet affects chemical conversion treatability and bondability. In the chemical conversion treatment step in the automotive manufacturing process, depending on the state of the chemical conversion treatment solution, etching performance may be decreased, resulting in no formation of phosphate crystals. In the case of the hot-dip galvanized steel sheet, in particular, because of the presence of the inactive Al-based oxide on the surface, when the etching performance of the chemical conversion treatment solution is insufficient, unevenness is likely to occur. There may be a case in which the Al-based oxide is removed by alkaline degreasing before chemical conversion treatment and chemical conversion treatment can be performed satisfactorily. Even in such a case, if alkaline degreasing violates the mild conditions, the effect is not achieved, resulting in nonuniform distribution of the Al-based oxide. The unevenness after the chemical conversion treatment leads to unevenness in subsequent electrodeposition and other defects.

In the automotive manufacturing process, adhesives are used for the purposes of corrosion prevention, vibration isolation, improvement in bonding strength, etc. Some of the adhesives used for cold-rolled steel sheets and Zn—Fe alloy plating are incompatible with the Al-based oxide, and satisfactory bonding strength cannot be achieved.

As described above, chemical conversion treatability and bondability can be improved by removing the Al-oxide layer on the surface of the hot-dip galvanized steel sheet. However, since the oxide layer on the surface is removed, the ability to prevent adhesion to the press die is weakened, resulting in degradation in press formability.

Based on the findings described above, the present invention realizes the optimum surface state in which sliding performance at low surface pressures is improved, satisfactory press formability is achieved, and chemical conversion treatability and bondability are also improved, and moreover, in which all of the above characteristics are exhibited.

Since the hot-dip galvanized steel sheet is usually produced by dipping a steel sheet in a zinc bath containing a very small amount of Al, the plating layer is substantially composed of the η phase, and the Al-based oxide layer resulting from Al contained in the zinc bath is formed on the surface. The η phase is softer than the ξ phase or the δ phase which is the alloy phase of the hot-dip galvannealed steel sheet, and the melting point of the η phase is lower. Consequently, adhesion is likely to occur and sliding performance is poor during press forming. However, in the case of the hot-dip galvanized steel sheet, since the Al-based oxide layer is formed on the surface, an effect of preventing adhesion to the die is slightly exhibited. In particular, when the hot-dip galvanized steel sheet slides over a die and when the sliding distance is short, degradation in the sliding performance may not occur. However, since the Al-based oxide layer formed on the surface is thin, as the sliding distance is increased, adhesion becomes likely to occur, and it is not possible to obtain satisfactory press formability under the extended sliding conditions. Furthermore, the hot-dip galvanized steel sheet is soft and more easily adheres to the die compared with other types of plating. When the surface pressure is low, the sliding performance is degraded.

In order to prevent adhesion between the hot-dip galvanized steel sheet and the die, it is effective to form a thick oxide layer uniformly on the surface of the steel sheet. Consequently, it is effective in improving the sliding performance of the hot-dip galvanized steel sheet to form the oxide layer including both the Zn-based oxide and the Al-based oxide by partially breaking down the Al-based oxide layer on the surface of the plating layer and forming the Zn oxide-based layer by oxidation. As will be described below, in a more preferred embodiment, Zn-based oxide layer primarily composed of Zn having microirregularities, which is formed according to the method of the present invention, covers substantially most of the surface of the plating layer (at an areal rate of 70% or more).

In the regions in which the Al-based oxide layer present on the plating layer of the galvanized steel sheet is partially broken down by temper rolling or the like and a new surface is exposed, the reactivity is increased, and the Zn-based oxide can be easily generated. In contrast, the region in which the Al-based oxide layer remains is inactive, and the oxidation does not advance. In the region in which the Zn-based oxide is formed, since the thickness of the oxide layer can be easily controlled, it is possible to obtain the thickness of the oxide layer required for improving the sliding performance. During actual press forming, the die is brought into contact with the oxide layer including the Zn-based oxide and the Al-based oxide. Even if the Al-based oxide layer is scraped away to cause a state in which adhesion easily occurs, since the Zn-based oxide layer can exhibit the adhesion-preventing effect, it is possible to improve the press formability.

When the thickness of the oxide layer is controlled, if a large thickness is attempted to be obtained, the thickness of the region in which the Zn-based oxide is present becomes large and the thickness of the region in which the Al-based oxide layer remains does not become large. Consequently, an oxide layer with a nonuniform thickness in which thick regions and thin regions are present is formed over the entire surface of the plating layer. However, because of the same mechanism as that described above, it is possible to improve the sliding performance. In addition, even if the thin regions partially do not include the oxide layer for some reason, it is possible to improve the sliding performance because of the same mechanism.

By setting the average thickness of the oxide layer at 10 nm or more, satisfactory sliding performance can be obtained. To set the average thickness of the oxide layer at 20 nm or more is more effective. The reason for this is that in press working in which the contact area between the die and the workpiece is large, even if the surface region of the oxide layer is worn away, the oxide layer remains, and thus the sliding performance is not degraded. On the other hand, although there is no upper limit for the average thickness of the oxide layer in view of the sliding performance, if a thick oxide layer is formed, the reactivity of the surface is extremely decreased, and it becomes difficult to form a chemical conversion coating. Therefore, the average thickness of the oxide layer is desirably 200 nm or less.

In the hot-dip galvanized steel sheet, since the Zn-plating layer is softer and has a lower melting point compared with other types of plating, sliding performance easily changes with the surface pressure, and the sliding performance is low at low surface pressures. In order to overcome this problem, an oxide with a thickness of 10 nm or more (more preferably 20 nm or more) must also be disposed on the convexities and/or planar portions other than the convexities of the surface of the plating layer formed by rolling. Since the concavities are relatively active because the Al-based oxide is broken down, the oxide is easily formed on the concavities. The oxide is not easily formed in other regions. Consequently, it is effective to decrease the amount of the Al-based oxide by proper activation treatment. The activation treatment may be performed by a method in which the Al-oxide is mechanically removed, such as rolling with a roller, shot blasting, or brushing; or by a method in which the Al-oxide is dissolved in an alkaline solution. The activation treatment is important in order to improve the sliding performance by enlarging the region coated with the oxide and also important in order to set the Al content in the oxide to a proper value so that both chemical conversion treatability and bondability are improved. In the chemical conversion treatment, the reactivity between the Zn of the plating layer and phosphoric acid must be maintained as much as possible in the chemical conversion treatment solution. It is effective to decrease the Al-based oxide component which is hard to dissolve in a weakly acidic chemical conversion treatment solution. In order to increase the bonding strength with the adhesive, a decrease in the amount of the Al-based oxide is also effective. An oxide primarily composed of Zn with a Zn/Al ratio (atomic concentration ration in the oxide layer) of 4.0 or more is effective. In order to show the effect, the oxide primarily composed of Zn must sufficiently cover the surface of the plating layer and must cover a given surface of the plating layer at an areal rate of 70% or more.

The Zn/Al atomic concentration ratio must be 4.0 or more, and this range also includes a case in which Al is not present.

The Zn/Al ratio can be measured by Auger electron spectroscopy (AES). As in the measurement of the oxide layer described above, the distribution of the composition in the depth direction in the planar portion on the surface of the plating layer is measured. The thickness of the oxide layer is estimated based on the measurement results, and based on the Zn average concentration (atomic percent) and the Al average concentration (atomic percent) up to the depth corresponding to the thickness of the oxide layer, the Zn/Al ratio is calculated. However, the composition of the oxide formed on the actual surface is not necessarily uniform, and in the very small region of the nm level, portions with a high Al concentration and portions with a low Al concentration may be present. Consequently, in order to measure the Zn/Al ratio, it is important to measure the average composition with respect to a relatively wide region of about 2 μm×2 μm or more.

In the method in which Auger electron spectoroscopy is performed along with sputtering, there is a possibility that the Al concentration may be higher than a value measured based on a cross section obtained by TEM or the like. Herein, the Zn/Al ratio is defined as the value measured by Auger electron spectroscopy.

The coverage of the oxide primarily composed of Zn with a Zn/Al ratio (atomic concentration ratio in the oxide layer) of 4.0 or more can be measured as follows.

In order to display the effect more satisfactorily, the oxide primarily composed of Zn with a Zn/Al ratio of 4.0 or more must cover the surface of the plating layer sufficiently, and the coverage must be at least 70% on a given surface of the plating layer. The coverage of the oxide primarily composed of Zn with a Zn/Al ratio of 4.0 or more can be measured by element mapping using an X-ray microanalyzer (EPMA) or a scanning electron microscope (SEM). In the EPMA, the intensities or the ratio of O, Al, and Zn resulting from the key oxide are preliminarily obtained, and data of the element mapping measured based on this is processed. Thereby, the areal rate can be estimated. On the other hand, it is possible to estimate the areal rate more simply by SEM image observation using an electron beam at an accelerating voltage of about 0.5 kV. Under this condition, since the portion in which the oxide is formed and the portion in which the oxide is not formed on the surface can be clearly distinguished, the areal rate can be measured by binarizing the resultant secondary electron image using an image processing software. However, it is necessary to preliminarily confirm by AES, EDS, or the like if the observed contrast corresponds to the key oxide.

By forming microirregularities in the oxide primarily composed of Zn, sliding friction can be further reduced. The microirregularities are defined by a surface roughness in which the average roughness (Ra) determined based on the roughness curve is about 100 nm or less and the mean spacing (S) of local irregularities determined based on the roughness curve is about 1,000 nm or less.

The sliding friction is reduced by the microirregularities because the concavities of the microirregularities are believed to function as a group of fine oil pits so that a lubricant can be effectively caught therein. That is, in addition to the sliding friction reducing effect as the oxide, a further sliding friction reducing effect is believed to be exhibited because of the fine sump effect in which the lubricant is effectively retained in the sliding section. Such a lubricant-retaining effect of the microirregularities is particularly effective in stably reducing the sliding friction of the hot-dip galvanized layer which has a relatively smooth surface macroscopically, in which a lubricant is not easily retained macroscopically, and on which it is difficult to stably form a macroscopic surface roughness by rolling or the like in order to achieve lubricity. The lubricant-retaining effect of the microirregularities is particularly effective under the sliding conditions in which the contact surface pressure is low.

With respect to the structure of the microirregularities, for example, the surface of the Zn-based oxide layer may have microirregularities. Alternatively, a Zn-based oxide in a granular, tabular, or scaly shape may be distributed directly on the surface of the plating layer or on the oxide layer and/or hydroxide layer. Desirably, the microirregularities have Ra of 100 nm or less and S of 800 nm or less. Even if Ra and S are increased from the above upper limits, the lubricant-retaining effect is not substantially improved, and it becomes necessary to apply the oxide thickly, resulting in a difficulty in production. Although the lower limits of the parameters are not particularly defined, it has been confirmed that the sliding friction-reducing effect is exhibited at Ra of 3 nm or more and S of 50 nm or more. More preferably, Ra is 4 nm or more. If the microirregularities become too small, the surface becomes close to a smooth surface, resulting in a reduction in the viscous oil-retaining effect, which is not advantageous.

One of the methods effective in controlling Ra and S is to incorporate Fe into the Zn-based oxide as will be described below. If Fe is incorporated into the Zn-based oxide, the Zn oxide gradually becomes finer and the number of pieces increases with the Fe content. By controlling the Fe content and the growth time, it is possible to adjust the size and distribution of the Zn oxide, and thereby Ra and S can be adjusted. This is not restricted by the shape of the microirregularities.

The surface roughness parameters, i.e., Ra and S, can be calculated according to the formulae described in Japan Industrial Standard B-0660-1998 "Surface roughness—Terms", etc., based on the roughness curve with a length of several microns extracted from the digitized surface shape of the Zn-based oxide using a scanning electron microscope or scanning probe microscope (such as an atomic force microscope) having three-dimensional shape measuring function. The shape of the microirregularities can be observed using a high-resolution scanning electron microscope. Since the thickness of the oxide is small at about several tens of nanometers, it is effective to observe the surface at a low accelerating voltage, for example, at 1 kV or less. In particular, if the secondary electron image is observed by excluding secondary electrons with low energy of about several electron volts as electron energy, it is possible to reduce contrast caused by the electrostatic charge of the oxide. Consequently, the shape of the microirregularities can be observed satisfactorily (refer to Nonpatent Literature 1).

The method for forming the microirregularities in the Zn-based oxide is not particularly limited. One of the effective methods is to incorporate Fe into the Zn-based oxide. By incorporating Fe into the Zn-based oxide, the size of the Zn-based oxide can be miniaturized. An aggregate of the miniaturized oxide pieces makes microirregularities. Although the reason why the oxide containing Zn and Fe is formed into an oxide having microirregularities is not clear, it is assumed that the growth of the Zn oxide is inhibited by Fe or the oxide of Fe. Although the preferable ratio (percent) of Fe to the sum of Zn and Fe is not clarified, the present inventors have confirmed that the Fe content of at least 1 to 50 atomic percent is effective. More preferably, the Fe content is 5 to 25 atomic percent.

Such an oxide containing Zn and Fe is formed by incorporating Fe into an acidic solution in the method in which the hot-dip galvanized steel sheet is brought into contact with the acidic solution having a pH buffering effect which will be described below. The preferable concentration range is 1 to 200 g/l as divalent or trivalent Fe ions. The more preferable concentration range is 1 to 80 g/l. Although the method for adding Fe ions is not particularly limited, for example, at an Fe ion concentration of 1 to 80 g/l, ferrous sulfate (heptahydrate) may be added in the range of 5 to 400 g/l.

In order to form the oxide layer, a method is effective in which a hot-dip galvanized steel sheet is brought into contact with an acidic solution having a pH buffering effect, allowed to stand for 1 to 30 seconds, and then washed with water, followed by drying.

Although the mechanism of the formation of the oxide layer is not clear, it is thought to be as follows. When the hot-dip galvanized steel sheet is brought into contact with the acidic solution, zinc on the surface of the steel sheet starts to be dissolved. When zinc is dissolved, hydrogen is also generated. Consequently, as the dissolution of zinc advances, the hydrogen ion concentration in the solution decreases, resulting in an increase in the pH of the solution. A Zn-based oxide layer is thereby formed on the surface of the hot-dip galvanized steel sheet. As described above, in order to form the Zn-based oxide, zinc must be dissolved and the pH of the solution in contact with the steel sheet must be increased. Therefore, it is effective to adjust the retention time after the steel sheet is brought into contact with the acidic solution until washing with water is performed. If the retention time is less than one second, the liquid is washed away before the pH of the solution with which the steel sheet is in contact is increased. Consequently, it is not possible to form the oxide. On the other hand, even if the steel sheet is allowed to stand for 30 seconds or more, there is no change in the formation of the oxide.

In the present invention, the retention time until washing with water is performed is important to the formation of the oxide. During the retention period, the oxide (or hydroxide) having the particular microirregularities grows. The more preferable retention time is 2 to 10 seconds.

The acidic solution used for the oxidation treatment preferably has a pH of 1.0 to 5.0. If the pH exceeds 5.0, the dissolution rate of zinc is decreased. If the pH is less than 1.0, the dissolution of zinc is excessively accelerated. In either case, the formation rate of the oxide is decreased. Preferably, a chemical solution having a pH buffering effect is added to the acidic solution. By using such a chemical solution, pH stability is imparted to the treatment liquid during the actual production. In the process in which the Zn-based oxide is formed due to the increase in pH in response to the dissolution of Zn, a local increase in pH is also prevented, and by providing the proper reaction time, the oxide growth time can be secured. Thereby, the oxide having microirregularities characterized in the present invention is effectively formed. The anion species of the acidic solution are not particularly limited, and examples thereof include chloride ions, nitrate ions, and sulfate ions. More preferably, sulfate ions are used.

Any chemical solution which has a pH buffering effect in the acidic range may be used. Examples thereof include acetates, such as sodium acetate ($CH_3COONa$); phthalates, such as potassium hydrogen phthalate ($(KOOC)_2C_6H_4$); citrates, such as sodium citrate ($Na_3C_6H_5O_7$) and potassium dihydrogen citrate ($KH_2C_6H_5O_7$); succinates, such as sodium succinate ($Na_2C_4H_4O_4$); lactates, such as sodium lactate ($NaCH_3CHOHCO_2$); tartrates, such as sodium tartrate ($Na_2C_4H_4O_6$); borates; and phosphates. These may be used alone or in combination of two or more.

The concentration of the chemical solution is preferably 5 to 50 g/l. If the concentration is less than 5 g/l, the pH buffering effect is insufficient, and it is not possible to form a desired oxide layer. If the concentration exceeds 50 g/l, the effect is saturated, and it also takes a long time to form the oxide. By bringing the galvanized steel sheet into contact with the acidic solution, Zn from the plating layer is dissolved in the acidic solution, which does not substantially prevent the formation of the Zn-based oxide. Therefore, the Zn concentration in the acidic solution is not specifically defined. As a more preferable pH buffering agent, a solution containing sodium acetate trihydrate in the range of 10 to 50 g/l, more preferably in the range of 20 to 50 g/l, is used. By using such a solution, the oxide of the present invention can be effectively obtained.

The method for bringing the galvanized steel sheet into contact with the acidic solution is not particularly limited. For example, a method in which the galvanized steel sheet is immersed in the acidic solution, a method in which the acidic solution is sprayed to the galvanized steel sheet, or a method in which the acidic solution is applied to the galvanized steel sheet using an application roller may be employed. Desirably, the acidic solution is applied so as to be present in a thin liquid film form on the surface of the steel sheet. If the amount of the acidic solution present on the surface of the steel sheet is large, even if zinc is dissolved, the pH of the solution is not increased, and only the dissolution of zinc occurs continuously. Consequently, it takes a long time to form the oxide layer, and the plating layer is greatly damaged. The original rust-preventing function of the steel sheet may be lost. From this viewpoint, the amount of the liquid film is preferably adjusted to 3 $g/m^2$ or less. The amount of the liquid film can be adjusted by squeeze rolling, air wiping, or the like.

The hot-dip galvanized steel sheet must be temper-rolled before the process of forming the oxide layer. The temper rolling operation is usually performed primarily in order to adjust the material quality. In the present invention, the temper rolling operation is also performed to partially break down the Al-based oxide layer present on the surface of the steel sheet.

The present inventors have observed the surface of the galvanized steel sheet before and after the formation of the oxide using a scanning electron microscope and found that the Zn-based oxide layer is mainly formed in the regions in which the Al-based oxide layer is broken down by the convexities of fine irregularities of the surface of the roller when the roller is brought into contact with the surface of the plating layer during temper rolling. Consequently, by controlling the roughness of the surface of the roller for temper rolling and elongation during temper rolling, the area of the broken down Al-based oxide layer can be controlled, and thereby the areal rate of the region in which the Zn-based oxide layer is formed can be controlled. Additionally, concavities can also be formed on the surface of the plating layer by such a temper rolling operation.

The example in which temper rolling is performed has been described above. Any other techniques which can mechanically break down the Al-based oxide layer on the surface of the plating layer may be effective in forming the Zn-based oxide and controlling the areal rate. Examples thereof include processing using a metallic brush and shot blasting.

It is also effective to perform activation treatment before the oxidation treatment, in which the steel sheet is brought into contact with an alkaline solution to activate the surface. This treatment is performed to further remove the Al-based oxide and to expose a new surface. In the temper rolling operation described above, there may be a case in which the Al-based oxide layer is not broken down sufficiently depending on the type of the steel sheet because of the elongation restricted by the material. Therefore, in order to stably form an oxide layer having excellent sliding performance regardless of the type of the steel sheet, it is necessary to activate the surface by further removing the Al-based oxide layer.

As a result of various research on the Al-based oxide on the surface, which has been obtained when the Al-based oxide layer is removed by contact with an alkaline solution or the like, before oxidation treatment, the preferred state of the Al-based oxide layer which is effective in forming the oxide primarily composed of Zn having the microirregularities defined in the present invention is as follows.

It is not necessary to completely remove the Al-based oxide on the surface and the Al-based oxide may be present along with the Zn-based oxide on the surface of the plating layer. Preferably, the average concentration of Al which is contained in the oxide on the planar portions on the surface is less than 20 atomic percent. The Al concentration is defined as the maximum value of the Al concentration within the depth corresponding to the thickness of the oxide when the average thickness of the oxide and the distribution of the Al concentration in the depth direction in a range of about 2 μm×2 μm are measured by Auger electron spectroscopy (AES) and Ar sputtering.

If the Al concentration is 20 atomic percent or more, it becomes difficult to form the oxide primarily composed of Zn having local microirregularities, resulting in a difficulty in covering the surface of the plating layer with the oxide primarily composed of Zn at an areal rate of 70% or more. Consequently, sliding performance, in particular, sliding performance under the conditions of low surface pressure, chemical conversion treatability, and bondability are decreased.

In order to produce the state of the Al-based oxide described above, although a mechanical removal method, such as contact with a roller, shot blasting, or brushing may be performed, contact with an aqueous alkaline solution is more effective. In such a case, preferably, the pH of the aqueous solution is set at 11 or more, the bath temperature is set at 50° C. or more, and the contact time with the solution is set to be one second or more. Any type of solution may be used as long as its pH is within the above range. For example, sodium hydroxide or a sodium hydroxide-based degreaser may be used.

The activation treatment must be performed before the oxidation treatment and may be performed before or after the temper rolling operation performed after hot-dip galvanizing. However, if the activation treatment is performed after the temper rolling operation, since the Al-based oxide is mechanically broken down at the concavities formed by crushing with the roller for temper rolling, the removal amount of the Al oxide tends to vary depending on the concavities and the convexities and/or planar portions other than the concavities. Consequently, in some case, the amount of the Al oxide may become nonuniform in the plane after the activation treatment, and the subsequent oxidation treatment may become nonuniform, resulting in a difficulty obtaining satisfactory characteristics.

Therefore, a process is preferable in which, after plating, activation treatment is performed first so that a proper amount of the Al oxide is removed uniformly in the plane, temper rolling is then performed, and subsequently oxidation treatment is performed.

EXAMPLE 1

A hot-dip galvanized layer was formed on a cold-rolled steel sheet with a thickness of 0.8 mm, and then temper rolling was performed. In some samples, before or after the temper rolling operation, activation treatment was performed by bringing the steel sheet into contact with a solution in which the pH was varied by changing the concentration of a sodium hydroxide-based degreaser FC-4370 (manufactured by Nihon Parkerizing Co., Ltd.) for a predetermined time.

Each of the samples subjected to the activation treatment and the temper rolling operation was immersed in a treatment liquid shown in Table 3 for 2 to 5 seconds, and the amount of the liquid on the surface of the sample was adjusted to 3 g/m$^2$ or less by squeeze rolling. The sample was left to stand in air for a predetermined time at room temperature. The standing time was changed depending on sample.

TABLE 3

| Treatment liquid No. | Sodium acetate trihydrate (g/l) | Ferrous sulfate heptahydrate (g/l) | Fe ion concentration (g/l) | pH (Note 1) |
|---|---|---|---|---|
| 1 | 40 | 0 | 0.0 | 2 |
| 2 | 40 | 20 | 4.0 | 2 |
| 3 | 40 | 40 | 8.0 | 1.5 |
| 4 | 20 | 0 | 0.0 | 2 |
| 5 | 0 | 0 | 0.0 | 2 |
| 6 | 0 | 49.8 | 10.0 | 2 |

(Note 1)
pH was adjusted by sulfuric acid.

With respect to each sample produced as described above, a press formability test was performed in which sliding performance was evaluated, and chemical conversion treatability and bondability were also evaluated. The thickness, distribution, and composition of the oxide layer were also measured. With respect to some of the samples, in order to confirm the effect of activation treatment, the oxide on the surface was analyzed before oxidation treatment.

Methods for characteristics evaluation and film analysis will be described below.

(1) Press Formability (Sliding Performance) Evaluation (Measurement of Coefficient of Friction)

The coefficient of friction of each sample was measured as in the first embodiment.

(2) Chemical Conversion Treatability

The chemical conversion treatability was evaluated as follows. A rust-preventive oil (NOX-RUST 550HN manufactured by Parker Industries, Inc.) was applied to each sample at about 1 g/m$^2$, and then alkaline degreasing (FC-E2001 manufactured by Nihon Parkerizing Co., Ltd., spraying, spray pressure: 1 kgf/cm$^2$), water washing, surface preparation (PL-Z manufactured by Nihon Parkerizing Co., Ltd.), and chemical conversion treatment (PB-L3080 manufactured by Nihon Parkerizing Co., Ltd.) were performed in that order to form a chemical conversion coating. The chemical conversion treatment time was set to be constant (2 minutes). In alkaline degreasing, the concentration of the degreasing solution was set at ½, and the degreasing time was set at 30 seconds, which were milder conditions compared with the standard conditions.

The evaluation was performed based on the appearances after chemical conversion treatment, using the following criteria.

○: No lack of hiding was observed, and the entire surface was covered with phosphate crystals.

Δ: Lack of hiding was slightly observed.

X: The surface included wide regions in which phosphate crystals were not formed.

(3) Bondability

Oil (Preton R352L manufactured by Sugimura Chemical Industrial Co., Ltd.) was applied to two test pieces with a dimension of 25×100 mm, and a vinyl chloride resin mastic sealer was applied to a region of 25×10 mm of each test piece. The regions coated with the adhesive were superposed on each other and dried in a drying kiln at 170° C. for 20 minutes to perform bonding. An I-shaped specimen was thereby formed. Tensile force was applied to this specimen at 5 mm/min with a tensile tester until break occurred at the bonding position. The maximum load during pulling was measured. The load was divided by the bonding area to determine a bonding strength.

The evaluation criteria were as follows:

○: Bonding strength of 0.2 MPa or more

X: Bonding strength of less than 0.2 MPa (4) Measurement of Thickness of Oxide Layer and Zn/Al Ratio of Oxide The distribution in the depth direction of composition in the surface region of the plating layer was determined using Auger electron spectroscopy (AES) by repeating $Ar^+$ sputtering and AES spectrum analysis. The sputtering time was converted to the depth according to the sputtering rate obtained by measuring a $SiO_2$ film with a known thickness. The composition (atomic percent) was determined based on the correction of the Auger peak intensities of the individual elements using relative sensitivity factors. In order to eliminate the influence of contamination, C was not taken into consideration. The O concentration resulting from oxides and hydroxides is high in the vicinity of the surface, decreases with depth, and becomes constant. The thickness of the oxide is defined as a depth that corresponds to a half of the sum of the maximum value and the constant value. A region of about 2 μm×2 μm in the planar portion was analyzed, and the average of the thicknesses measured at 2 to 3 given points was defined as the average thickness of the oxide layer. The Zn/Al ratio of the oxide was calculated based on the Zn average concentration (atomic percent) and the Al average concentration (atomic percent) in the range corresponding to the thickness of the oxide.

(5) Measurement of Surface State After Activation Treatment

In order to confirm the effect of activation treatment, as in the item (4) described above, the thickness of the oxide and the distribution in the depth direction of the Al concentration in the planar portion of the surface after the activation treatment were measured. The maximum Al concentration in the range corresponding to the thickness of the oxide was treated as an index of effect of activation treatment.

(6) Measurement of Areal Rate of Oxide Primarily Composed of Zn

In order to measure the areal rate of the oxide primarily composed of Zn, a scanning electron microscope (LEO1530 manufactured by LEO Company) was used, and a secondary electron image at a low magnification was observed at an accelerating voltage of 0.5 kV with an in-lens secondary electron detector. Under these observation conditions, the region in which the oxide primarily composed of Zn was formed was clearly distinguished as dark contrast from the region in which such an oxide was not formed. In the strict sense, the brightness distribution observed may be considered as the thickness distribution of oxides. However, herein, it was confirmed separately by AES that the oxide primarily composed of Zn with a Zn/Al ratio of 4.0 or more was thicker than the other oxides, and the dark region was considered as the oxide primarily composed of Zn with a Zn/Al ratio of 4.0 or more. The resultant secondary electron image was binarized by an image processing software, and the areal rate of the dark region was calculated to determine the areal rate of the region in which Zn-based oxide was formed.

(7) Measurement of Shape of Microirregularities and Roughness Parameters of Oxide The formation of the microirregularities of the Zn-based oxide was confirmed by a method in which, using a scanning electron microscope (LEO1530 manufactured by LEO Company), a secondary electron image at a high magnification was observed with an Everhart-Thornly secondary electron detector placed in a sample chamber at an accelerating voltage of 0.5 kV.

In order to measure the surface roughness of the Zn-based oxide, a three dimensional electron probe surface roughness analyzer (ERA-8800FE manufactured by Elionix Inc.) was used. The measurement was performed at an accelerating voltage of 5 kV and a working distance of 15 mm. Sampling distance in the in-plane direction was set at 5 nm or less (at an observation magnification of 40,000 or more). Additionally, in order to prevent electrostatic charge build-up due to the electron beam irradiation, gold vapor deposition was performed. For each region in which the Zn-based oxide was present, 450 or more roughness curves with a length of about 3 μm in the scanning direction of the electron beam were extracted. At least three locations were measured for each sample.

Based on the roughness curves, using an analysis software attached to the apparatus, the average surface roughness (Ra) of the roughness curves and the mean spacing (S) of local irregularities of the roughness curves were calculated. Herein, Ra and S are parameters for evaluating the roughness of the microirregularities and the period, respectively. The general definitions of these parameters are described in Japan Industrial Standard B-0660-1998 "Surface roughness—Terms", etc. In the present invention, the roughness parameters are based on roughness curves with a length of several micrometers, and Ra and S are calculated according to the formulae defined in the literature described above.

When the surface of the sample is irradiated with an electron beam, contamination primarily composed of carbon may grow and appear in the measurement data. Such an influence is likely to become remarkable when the region measured is small as in this case. Therefore, when the data was analyzed, this influence was eliminated using a Spline hyper filter with a cut-off wavelength corresponding to a half of the length in the measurement direction (about 3 μm). In order to calibrate the apparatus, SHS Thin Step Height Standard (Steps 18 nm, 88 nm, and 450 nm) manufactured by VLSI standards Inc. traceable to the U.S. national research institute NIST was used.

The results are shown in Tables 4 and 5.

(1) In Examples of the present invention (Sample Nos. 1 to 7), the sample was subjected to activation treatment using a degreasing liquid in which the concentration was adjusted and the a pH was set at 11 or more, and then brought into contact with an aqueous solution containing sodium acetate trihydrate as a pH buffering agent as shown in Table 3. By appropriately changing the retention time until washing with water, the oxide layer for each sample was formed. As a result of these treatments, the average thickness of oxide layer was 18 to 31 nm, the rate of the oxide primarily composed of Zn with a Zn/Al atomic concentration ratio of 4.0 or more was 90% to 96%. Consequently, the coefficient of friction was low, and excellent sliding performance was exhibited. The chemical conversion treatability and bondability were also satisfactory. In contrast, in each of Comparative Example (Sample No. 10) in which activation treatment was not performed and Comparative Example (Sample No. 11) in which the pH for activation treatment was less than 11, the areal rate of the oxide primarily composed of Zn was low at 25% or 40%, the coefficient of friction was high, and the sliding performance was poor. Furthermore, the chemical conversion treatability and bondability were inferior to Examples of the present invention.

Figure 3:
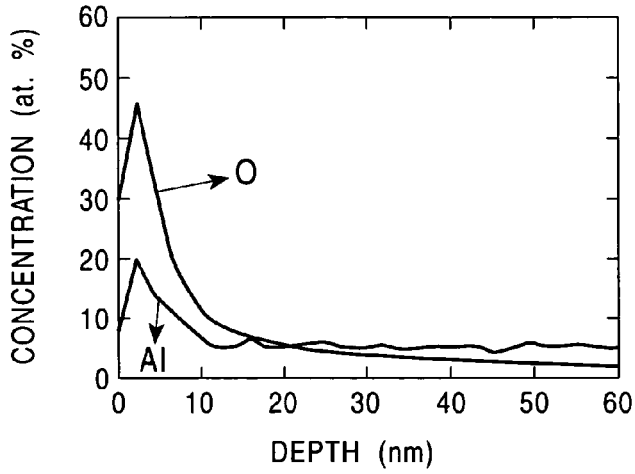
FIG. 3 is a graph which shows an Auger profile of the surface of Sample No. 1 shown in Table 4 in Embodiment 2 after activation and before oxidation.
Figure 4:
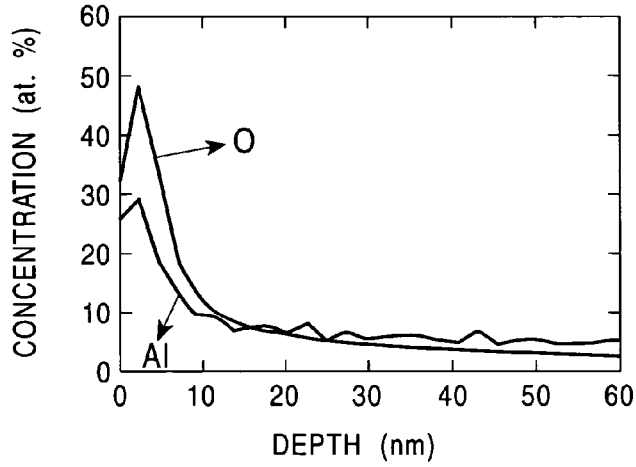
FIG. 4 is a graph which shows an Auger profile of the surface of Sample No. 11 shown in Table 4 in Embodiment 2 after activation and before oxidation.
Figure 5:
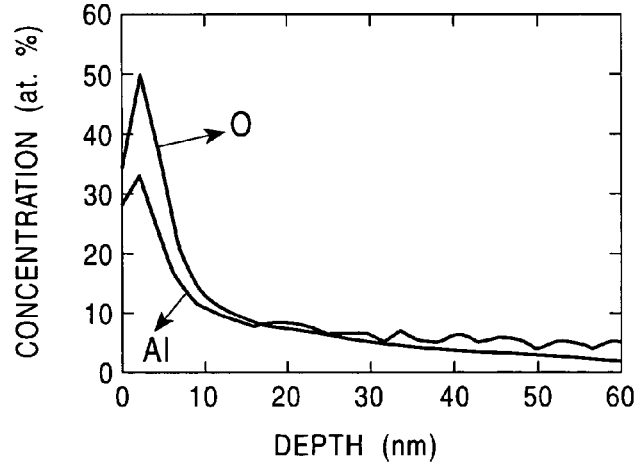
FIG. 5 is a graph which shows an Auger profile of the surface of Sample No. 12 shown in Table 4 in Embodiment 2 after activation and before oxidation.

(2) With respect to each of Sample Nos. 1, 11, and 12, a sample was collected during activation treatment, the distribution in the depth direction of the composition in the surface region of the plating layer was measured using Auger electron spectroscopy (AES) by repeating $Ar^+$ sputtering and spectrum analysis. The measurement results are shown in FIGS. 3, 4, and 5. As is clear from FIG. 3 showing the Auger profile in the depth direction of Sample No. 1, the Al concentration of the oxide is less than 20 atomic percent at any depth. In contract, in Sample No. 11 (Comparative Example) and Sample No 12 (Comparative Example) shown in FIGS. 4 and 5, the Al concentration is 20 atomic percent or more. Since the Sample No. 11 and Sample No. 1 (Example of the present invention) are subjected to oxidation treatment under the same conditions, it is clear that the difference in the areal rate of the oxide primarily composed of Zn after oxidation treatment results from the difference in the Al concentration at the surface obtained by activation treatment.

(3) Among Examples of the present invention, in Sample Nos. 4, 5, and 6, a treatment liquid containing Fe ions was used for oxidation treatment. As a result, 15 to 25 atomic percent of Fe was measured in the oxide primarily composed of Zn. Although Sample Nos. 3 and 4 are treated under substantially the same conditions except for the presence or absence of Fe ions in the treatment liquid, the sliding performance of Sample No. 4 containing Fe is slightly more satisfactory than Sample No. 3.

(4) In Sample No. 8 which is Comparative Example, although an acidic sulfuric acid solution is used as the treatment liquid, since a PH buffering agent is not incorporated therein, the coefficient of friction is high. The reason for this is believed to be that the areal rate of the oxide primarily composed of Zn is low and that the oxide does not have characteristic microirregularities as provided in the present invention. Furthermore, in Sample No. 9, since the oxidation treatment liquid does not contain a pH buffering agent, satisfactory characteristics are not achieved. In Sample Nos. 10 and 11, since activation treatment is not performed sufficiently, the areal rate of the oxide primarily composed of Zn is low, and in particular, chemical conversion treatability and bondability are inferior compared with Examples of the present invention. In Sample No. 12, which is an untreated hot-dip galvanized steel sheet, the amount of oxide is insufficient, and sliding performance, chemical conversion treatability, and bondability are inferior compared with Examples of the present invention.

TABLE 4

| | Activation treatment | | | Auger profile of | Oxidation treatment | | |
|---|---|---|---|---|---|---|---|
| Sample No. | Treatment liquid pH | Treatment temperature (° C.) | Before/after temper rolling (Note 1) | surface before oxidation treatment (Note 2) | Treatment liquid (Table 3) | Retention time until water washing (second) | Remarks |
| 1 | 12.5 | 50 | After | (FIG. 3) | 1 | 5 | EP |
| 2 | 11 | 80 | After | — | 1 | 20 | EP |
| 3 | 12.5 | 50 | Before | — | 1 | 4 | EP |
| 4 | 12.5 | 60 | Before | — | 2 | 5 | EP |
| 5 | 12 | 70 | Before | — | 3 | 5 | EP |
| 6 | 12 | 70 | After | — | 3 | 5 | EP |
| 7 | 12.5 | 50 | After | — | 4 | 5 | EP |
| 8 | 12.5 | 50 | After | — | 5 | 5 | CE |
| 9 | 12.5 | 50 | After | — | 6 | 5 | CE |
| 10 | None | | | — | 1 | 5 | CE |
| 11 | 10.5 | 50 | After | (FIG. 4) | 1 | 5 | CE |
| 12 | | None | | (FIG. 5) | None | | CE |

(Note 1)
Timing of activation treatment. Before: before temper rolling After: after temper rolling
(Note 2)
Auger profile in the depth direction in the planar portion measured after activation treatment and before oxidation treatment
EP: Example of Present Invention
CE: Comparative Example

TABLE 5

| Sample No. | Average thickness of oxide layer (nm) | Areal rate of oxide primarily composed of Zn (Note 3) (%) | Fe ratio in oxide primarily composed of Zn (Note 4) (at %) | Coefficient of friction | Chemical conversion treatability | Bondability | Remarks |
|---|---|---|---|---|---|---|---|
| 1 | 31 | 93 | — | 0.166 | ○ | ○ | EP |
| 2 | 24 | 92 | — | 0.168 | ○ | ○ | EP |
| 3 | 22 | 96 | — | 0.165 | ○ | ○ | EP |

TABLE 5-continued

| Sample No. | Average thickness of oxide layer (nm) | Areal rate of oxide primarily composed of Zn (Note 3) (%) | Fe ratio in oxide primarily composed of Zn (Note 4) (at %) | Coefficient of friction | Chemical conversion treatability | Bondability | Remarks |
|---|---|---|---|---|---|---|---|
| 4 | 18 | 91 | 15 | 0.155 | ○ | ○ | EP |
| 5 | 18 | 90 | 25 | 0.158 | ○ | ○ | EP |
| 6 | 22 | 92 | 20 | 0.163 | ○ | ○ | EP |
| 7 | 23 | 90 | — | 0.173 | ○ | ○ | EP |
| 8 | 12 | 45 | — | 0.242 | ○ | X | CE |
| 9 | 15 | 25 | 5 | 0.201 | ○ | X | CE |
| 10 | 12 | 25 | — | 0.193 | X | X | CE |
| 11 | 16 | 40 | — | 0.183 | Δ | X | CE |
| 12 | 8 | — | — | 0.269 | X | X | CE |

(Note 3)
Oxide primarily composed of Zn: Zn/Al atomic concentration ratio of 4.0 or more. Atomic concentration measuring method and areal rate measuring method are described in the specification.
(Note 4)
Fe ratio in oxide primarily composed of Zn: atomic concentration (at %) defined by Fe/(Zn + Fe). Measurement method is described in the specification.
EP: Example of Present Invention
CE: Comparative Example

Embodiment 3

Since a hot-dip galvanized steel sheet is usually produced by dipping a steel sheet in a zinc bath containing a very small amount of Al, the plating layer is substantially composed of the η phase, and the Al-based oxide layer resulting from Al contained in the zinc bath is formed on the surface. The η phase is softer than the ξ phase or the δ phase which is the alloy phase of a hot-dip galvannealed steel sheet, and the melting point of the η phase is lower. Consequently, adhesion is likely to occur and sliding performance is poor during press forming. However, in the case of the hot-dip galvanized steel sheet, since the Al-based oxide layer is formed on the surface, an effect of preventing adhesion to the die is slightly exhibited. In particular, when the hot-dip galvanized steel sheet slides over a die and when the sliding distance is short, degradation in the sliding performance may not occur. However, since the Al-based oxide layer formed on the surface is thin, as the sliding distance is increased, adhesion becomes likely to occur, and it is not possible to obtain satisfactory press formability under the extended sliding conditions. Furthermore, the hot-dip galvanized steel sheet is soft and more easily adheres to the die compared with other types of plating. When the surface pressure is low, the sliding performance is degraded.

In order to prevent adhesion between the hot-dip galvanized steel sheet and the die, it is effective to form a thick oxide layer uniformly on the surface of the steel sheet. Consequently, it is effective in improving the sliding performance of the hot-dip galvanized steel sheet to form a Zn-based oxide layer by partially breaking down the Al-based oxide layer on the surface of the plating layer, followed by oxidation.

Furthermore, by incorporating Fe into the Zn-based oxide, a higher sliding friction reducing effect can be achieved. Although the reason for this is not clear, it is assumed that by forming an oxide containing Fe, the adhesion of the oxide is improved, and the sliding friction reducing effect is likely to be maintained even during sliding. With respect to the proper Fe content, it has been confirmed that the Fe atomic ratio calculated from the expression Fe/(Fe+Zn) based on the Fe and Zn atomic concentrations at least in the range of 1% to 50% is effective. More preferably, by setting the ratio in the range of 5% to 25%, the effect can be achieved stably. The Fe and Zn atomic concentrations in the oxide are most appropriately determined based on the spectrum measured using a transmission electron microscope (TEM) and an energy dispersive X-ray analyzer (EDS) with respect to a sample of cross section of the surface layer containing oxide prepared by a FIB-μ sampling system. In other methods (e.g., AES and EPMA), it is not possible to sufficiently decrease the spatial resolution in the region to be analyzed, and it is difficult to analyze only the oxide on the surface. Furthermore, it has also been known that incorporation of Fe into the Zn-based oxide to be formed is effective in controlling the amount of the oxide formed and the application and shape (size) of microirregularities which will be described below. Consequently, this is advantageous in view of stable manufacturing of products.

By setting the average thickness of the Zn-based oxide containing Fe at 10 nm or more, satisfactory sliding performance can be obtained. To set the average thickness of the oxide layer at 20 nm or more is more effective. The reason for this is that in press working in which the contact area between the die and the workpiece is large, even if the surface region of the oxide layer is worn away, the oxide layer remains, and thus the sliding performance is not degraded. On the other hand, although there is no upper limit for the average thickness of the oxide layer in view of the sliding performance, if a thick oxide layer is formed, the reactivity of the surface is extremely decreased, and it becomes difficult to form a chemical conversion coating. Therefore, the average thickness of the oxide layer is desirably 200 nm or less.

The average thickness of the oxide layer can be determined by Auger electron spectroscopy (AES) combined with Ar ion sputtering. In this method, after sputtering is performed to a predetermined depth, the composition at the depth is determined based on the correction of the spectral intensities of the individual elements to be measured using relative sensitivity factors. The O content resulting from oxides reaches the maximum value at a certain depth (which may be the outermost layer), then decreases, and becomes constant. The thickness of the oxide is defined as a depth that corresponds to a half of the sum of the maximum value and the constant value at a position deeper than the maximum value. In order to display the effect more satisfactorily, it has been confirmed that the coverage of the oxide primarily composed of Zn must be at least 15% with respect to a given surface of the plating layer. The coverage of the oxide primarily composed of Zn can be measured by element mapping using an X-ray microanalyzer (EPMA) or a scanning electron microscope (SEM). In the EPMA, the intensities or the ratio of O, Al, and Zn resulting from the key oxide are preliminarily obtained, and data of the element mapping measured based on this is processed. Thereby, the areal rate can be estimated. On the other hand, it is possible to estimate the areal rate more simply by SEM image observation using an electron beam at an accelerating voltage of about 0.5 kV. Under this condition, since the portion in which the oxide is formed and the portion in which the oxide is not formed on the surface can be clearly distinguished, the areal rate can be measured by binarizing the resultant secondary electron image using an image processing software. However, it is necessary to preliminarily confirm by AES, EDS, or the like if the observed contrast corresponds to the key oxide.

Furthermore, by forming microirregularities in the oxide primarily composed of Zn, sliding friction can be further reduced. The microirregularities are defined by a surface roughness in which the average roughness (Ra) determined based on the roughness curve is about 100 nm or less and the mean spacing (S) of local irregularities determined based on the roughness curve is about 1,000 nm or less. The sliding friction is reduced by the microirregularities because the concavities of the microirregularities are believed to function as a group of fine oil pits so that a lubricant can be effectively caught therein. That is, in addition to the sliding friction reducing effect as the oxide, a further sliding friction reducing effect is believed to be exhibited because of the fine sump effect in which the lubricant is effectively retained in the sliding section. Such a lubricant-retaining effect of the microirregularities is particularly effective in stably reducing the sliding friction of the hot-dip galvanized layer which has a relatively smooth surface macroscopically, in which a lubricant is not easily retained macroscopically, and on which it is difficult to stably form a macroscopic surface roughness by rolling or the like in order to achieve lubricity. The lubricant-retaining effect of the microirregularities is particularly effective under the sliding conditions in which the contact surface pressure is low.

With respect to the structure of the microirregularities, for example, the surface of the Zn-based oxide layer may have microirregularities. Alternatively, a Zn-based oxide in a granular, tabular, or scaly shape may be distributed directly on the surface of the plating layer or on the oxide layer and/or hydroxide layer. Desirably, the microirregularities have Ra of 100 nm or less and S of 1,000 nm or less. Even if Ra and S are increased from the above upper limits, the lubricant-retaining effect is not substantially improved, and it becomes necessary to apply the oxide thickly, resulting in a difficulty in production. Although the lower limits of the parameters are not particularly defined, it has been confirmed that the sliding friction-reducing effect is exhibited at Ra of 3 nm or more and S of 50 nm or more. More preferably, Ra is 4 nm or more. If the microirregularities become too small, the surface becomes close to a smooth surface, resulting in a reduction in the viscous oil-retaining effect, which is not advantageous.

The surface roughness parameters, i.e., Ra and S, can be calculated according to the formulae described in Japan Industrial Standard B-0660-1998 "Surface roughness—Terms", etc., based on the roughness curve with a length of several microns extracted from the digitized surface shape of the Zn-based oxide using a scanning electron microscope or scanning probe microscope (such as an atomic force microscope) having three-dimensional shape measuring function. The shape of the microirregularities can be observed using a high-resolution scanning electron microscope. Since the thickness of the oxide is small at about several tens of nanometers, it is effective to observe the surface at a low accelerating voltage, for example, at 1 kV or less. In particular, if the secondary electron image is observed by excluding secondary electrons with low energy of about several electron volts as electron energy, it is possible to reduce contrast caused by the electrostatic charge of the oxide. Consequently, the shape of the microirregularities can be observed satisfactorily (refer to Nonpatent Literature 1).

As described above, by incorporating Fe into the Zn-based oxide, the oxide having microirregularities can be formed, and moreover, it is possible to control the size of the microirregularities, i.e., Ra and S. By incorporating Fe into the Zn-based oxide, the size of the Zn-based oxide can be miniaturized. An aggregate of the miniaturized oxide pieces makes microirregularities. Although the reason why the oxide containing Zn and Fe is formed into an oxide having microirregularities is not clear, it is assumed that the growth of the Zn oxide is inhibited by Fe or the oxide of Fe.

In order to form the oxide layer, a method is effective in which a hot-dip galvanized steel sheet is brought into contact with an acidic solution having a pH buffering effect, allowed to stand for 1 to 30 seconds, and then washed with water, followed by drying. The Zn-based oxide containing Fe according to the present invention can be formed by adding Fe into the acidic solution having the pH buffering effect. Although the concentration is not particularly limited, addition of ferrous sulfate (heptahydrate) in the range of 5 to 400 g/l enables the formation. However, as described above, in order to set the Fe ratio in the oxide to be 5% to 25%, more preferably, the ferrous sulfate (heptahydrate) content is in the range of 5 to 200 g/l.

Although the mechanism of the formation of the oxide layer is not clear, it is thought to be as follows. When the hot-dip galvanized steel sheet is brought into contact with the acidic solution, zinc on the surface of the steel sheet starts to be dissolved. When zinc is dissolved, hydrogen is also generated. Consequently, as the dissolution of zinc advances, the hydrogen ion concentration in the solution decreases, resulting in an increase in the pH of the solution. A Zn-based oxide layer is thereby formed on the surface of the hot-dip galvanized steel sheet. As described above, in order to form the Zn-based oxide, zinc must be dissolved and the pH of the solution in contact with the steel sheet must be increased. Therefore, it is effective to adjust the retention time after the steel sheet is brought into contact with the acidic solution until washing with water is performed. If the retention time is less than one second, the liquid is washed away before the pH of the solution with which the steel sheet is in contact is increased. Consequently, it is not possible to form the oxide. On the other hand, even if the steel sheet is allowed to stand for 30 seconds or more, there is no change in the formation of the oxide.

In the present invention, the retention time until washing with water is performed is important to the formation of the oxide. During the retention period, the oxide (or hydroxide) having the particular microirregularities grows. The more preferable retention time is 2 to 10 seconds.

The acidic solution used for the oxidation treatment preferably has a pH of 1.0 to 5.0. If the pH exceeds 5.0, the dissolution rate of zinc is decreased. If the pH is less than 1.0, the dissolution of zinc is excessively accelerated. In either case, the formation rate of the oxide is decreased. Preferably, a chemical solution having a pH buffering effect is added to the acidic solution. By using such a chemical solution, pH stability is imparted to the treatment liquid during the actual production. In the process in which Zn-based oxide is formed due to the increase in pH in response to the dissolution of Zn, a local increase in pH is also prevented, and by providing the proper reaction time, the oxide growth time can be secured. Thereby, the oxide having microirregularities characterized in the present invention is effectively formed.

Any chemical solution which has a pH buffering effect in the acidic range may be used. Examples thereof include acetates, such as sodium acetate ($CH_3COONa$); phthalates, such as potassium hydrogen phthalate ($(KOOC)_2C_6H_4$); citrates, such as sodium citrate ($Na_3C_6H_5O_7$) and potassium dihydrogen citrate ($KH_2C_6H_5O_7$); succinates, such as sodium succinate ($Na_2C_4H_4O_4$) lactates, such as sodium lactate ($NaCH_3CHOHCO_2$); tartrates, such as sodium tartrate ($Na_2C_4H_4O_6$); borates; and phosphates. These may be used alone or in combination of two or more.

The concentration of the chemical solution is preferably 5 to 50 g/l. If the concentration is less than 5 g/l, the pH buffering effect is insufficient, and it is not possible to form a desired oxide layer. If the concentration exceeds 50 g/l, the effect is saturated, and it also takes a long time to form the oxide. By bringing the galvanized steel sheet into contact with the acidic solution, Zn from the plating layer is dissolved in the acidic solution, which does not substantially prevent the formation of the Zn oxide. Therefore, the Zn concentration in the acidic solution is not specifically defined. As a more preferable pH buffering agent, a solution containing sodium acetate trihydrate in the range of 10 to 50 g/l, more preferably in the range of 20 to 50 g/l, is used. By using such a solution, the oxide of the present invention can be effectively obtained.

The method for bringing the galvanized steel sheet into contact with the acidic solution is not particularly limited. For example, a method in which the galvanized steel sheet is immersed in the acidic solution, a method in which the acidic solution is sprayed to the galvanized steel sheet, or a method in which the acidic solution is applied to the galvanized steel sheet using an application roller may be employed. Desirably, the acidic solution is applied so as to be present in a thin liquid film form on the surface of the steel sheet. If the amount of the acidic solution present on the surface of the steel sheet is large, even if zinc is dissolved, the pH of the solution is not increased, and only the dissolution of zinc occurs continuously. Consequently, it takes a long time to form the oxide layer, and the plating layer is greatly damaged. The original rust-preventing function of the steel sheet may be lost. From this viewpoint, the amount of the liquid film is preferably adjusted to 3 $g/m^2$ or less. The amount of the liquid film can be adjusted by squeeze rolling, air wiping, or the like.

The hot-dip galvanized steel sheet must be temper-rolled before the process of forming the oxide layer. The temper rolling operation is usually performed primarily in order to adjust the material quality. In the present invention, the temper rolling operation is also performed to partially break down the Al-based oxide layer present on the surface of the steel sheet.

The present inventors have observed the surface of the galvanized steel sheet before and after the formation of the oxide using a scanning electron microscope and found that the Zn-based oxide is mainly formed in the regions in which the Al-based oxide layer is broken down by the convexities of fine irregularities of the surface of the roller when the roller is brought into contact with the surface of the plating layer during temper rolling. Consequently, by controlling the roughness of the surface of the roller and elongation during temper rolling, the area of the broken down Al-based oxide layer can be controlled, and thereby the areal rate and distribution of the Zn-based oxide layer can be controlled. Additionally, concavities can also be formed on the surface of the plating layer by such a temper rolling operation.

The example in which temper rolling is performed has been described above. Any other techniques which can mechanically break down the Al-based oxide layer on the surface of the plating layer may be effective in forming the Zn-based oxide and controlling the areal rate. Examples thereof include processing using a metallic brush and shot blasting.

It is also effective to perform activation treatment before the oxidation treatment, in which the steel sheet is brought into contact with an alkaline solution to activate the surface. This treatment is performed to further remove the Al-based oxide and to expose a new surface. In the temper rolling operation described above, there may be a case in which the Al-based oxide layer is not broken down sufficiently depending on the type of the steel sheet because of the elongation restricted by the material. Therefore, in order to stably form an oxide layer having excellent sliding performance regardless of the type of the steel sheet, it is necessary to activate the surface by further removing the Al-based oxide layer.

When the steel sheet is brought into contact with the aqueous alkaline solution, preferably, the pH of the aqueous solution is set at 11 or more, the bath temperature is set at 50° C. or more, and the contact time with the solution is set to be one second or more. Any type of solution may be used as long as its pH is within the above range. For example, sodium hydroxide or a sodium hydroxide-based degreaser may be used.

The activation treatment must be performed before the oxidation treatment and may be performed before or after the temper rolling operation performed after hot-dip galvanizing. However, if the activation treatment is performed after the temper rolling operation, since the Al-based oxide is mechanically broken down at the concavities formed by crushing with the roller for temper rolling, the removal amount of the Al oxide tends to vary depending on the concavities and the convexities and/or planar portions other than the concavities. Consequently, in some case, the amount of the Al oxide may become nonuniform in the plane after the activation treatment, and the subsequent oxidation treatment may become nonuniform, resulting in a difficulty obtaining satisfactory characteristics.

Therefore, a process is preferable in which, after plating, activation treatment is performed first so that a proper amount of the Al oxide is removed uniformly in the plane, temper rolling is then performed, and subsequently oxidation treatment is performed.

When the hot-dip galvanized steel sheet of the present invention is produced, Al must be incorporated into the plating bath. The additive elements other than Al are not particularly limited. That is, the advantage of the present invention is not degraded even if Pb, Sb, Si, Sn, Mg, Mn, Ni, Ti, Li, Cu, or the like is incorporated besides Al. The advantage of the present invention is also not degraded even if a very small amount of P, S, N, B, Cl, Na, Mn, Ca, Mg, Ba, Sr, Si, or the like is incorporated into the oxide layer due to the inclusion of impurities during oxidation.

The present invention will be described in more detail based on the example below.

EXAMPLE

A hot-dip galvanized layer was formed on a cold-rolled steel sheet with a thickness of 0.8 mm, and then temper rolling was performed. Before or after the temper rolling operation, activation treatment was performed by bringing each sample into contact with a solution of sodium hydroxide-based degreaser FC-4370 manufactured by Nihon Parkerizing Co., Ltd. for a predetermined time. In order to form the oxide, each sample subjected to the activation treatment and the temper rolling operation was immersed in an acidic solution with varied contents of sodium acetate trihydrate and ferrous sulfate heptahydrate and with varied pH for 2 to 5 seconds. The amount of the liquid on the surface of the sample was adjusted to 3 $g/m^2$ or less by squeeze rolling, and the sample was left to stand in air for 5 seconds. For comparison, a sample which was not subjected to activation treatment and oxidation treatment (as hot-dip galvanized) and a sample which was subjected to oxidation treatment without activation treatment were also prepared.

With respect to each sample thus prepared, a press formability test was performed in which sliding performance was evaluated, and in order to evaluate the surface shape, the thickness of the oxide layer, the coverage of the oxide, and the shape of microirregularities were measured. Methods for characteristics evaluation and film analysis will be described below.

(1) Press Formability (Sliding Performance) Evaluation (Measurement of Coefficient of Friction)

The coefficient of friction of each sample was measured as in the first embodiment.

(2) Measurement of Fe in Oxide

In order to obtain the Fe ratio in the oxide, a sample of cross section of the surface layer containing the oxide prepared by a FIB-μ sampling system was measured with a transmission electron microscope (TEM; CM20FEG manufactured by Philips Crop.) and an energy dispersive X-ray analyzer (EDS; manufactured by EDAX Crop.). The spectrum of the oxide was measured with EDS, and Fe and Zn atomic concentrations were estimated based on the peak intensities. The Fe ratio in the oxide was calculated from the expression Fe/(Fe+Zn).

(3) Measurement of Thickness of Oxide Layer

The distribution in the depth direction of composition on the surface of the plating layer was determined using Auger electron spectroscopy (AES) by repeating $Ar^+$ sputtering and AES spectrum analysis. The sputtering time was converted to the depth according to the sputtering rate obtained by measuring a $SiO_2$ film with a known thickness. The composition (atomic percent) was determined based on the correction of the Auger peak intensities of the individual elements using relative sensitivity factors. In order to eliminate the influence of contamination, C was not taken into consideration. The O concentration resulting from oxides and hydroxides is high in the vicinity of the surface, decreases with depth, and becomes constant. The thickness of the oxide is defined as a depth that corresponds to a half of the sum of the maximum value and the constant value. A region of about 2 μm×2 μm in the planar portion was analyzed, and the average of the thicknesses measured at 2 to 3 given points was defined as the average thickness of the oxide layer.

(4) Measurement of Areal Rate of Oxide Primarily Composed of Zn

In order to measure the areal rate of the oxide primarily composed of Zn, a scanning electron microscope (LEO1530 manufactured by LEO Company) was used, and a secondary electron image at a low magnification was observed at an accelerating voltage of 0.5 kV with an in-lens secondary electron detector. Under these observation conditions, the region in which the oxide primarily composed of Zn was formed was clearly distinguished as dark contrast from the region in which such an oxide was not formed. The resultant secondary electron image was binarized by an image processing software, and the areal rate of the dark region was calculated to determine the areal rate of the region in which Zn-based oxide was formed.

(5) Measurement of Shape of Microirregularities and Roughness Parameters of Oxide The formation of the microirregularities of the Zn-based oxide was confirmed by a method in which, using a scanning electron microscope (LEO1530 manufactured by LEO Company), a secondary electron image at a high magnification was observed with an Everhart-Thornly secondary electron detector placed in a sample chamber at an accelerating voltage of 0.5 kV.

In order to measure the surface roughness of the Zn-based oxide, a three dimensional electron probe surface roughness analyzer (ERA-8800FE manufactured by Elionix Inc.) was used. The measurement was performed at an accelerating voltage of 5 kV and a working distance of 15 mm. Sampling distance in the in-plane direction was set at 5 nm or less (at an observation magnification of 40,000 or more). Additionally, in order to prevent electrostatic charge build-up due to the electron beam irradiation, gold vapor deposition was performed. For each region in which the Zn-based oxide was present, 450 or more roughness curves with a length of about 3 μm in the scanning direction of the electron beam were extracted. At least three locations were measured for each sample.

Based on the roughness curves, using an analysis software attached to the apparatus, the average surface roughness (Ra) of the roughness curves and the mean spacing (S) of local irregularities of the roughness curves were calculated. Herein, Ra and S are parameters for evaluating the roughness of the microirregularities and the period, respectively. The general definitions of these parameters are described in Japan Industrial Standard B-0660-1998 "Surface roughness—Terms", etc. In the present invention, the roughness parameters are based on roughness curves with a length of several micrometers, and Ra and S are calculated according to the formulae defined in the literature described above.

When the surface of the sample is irradiated with an electron beam, contamination primarily composed of carbon may grow and appear in the measurement data. Such an influence is likely to become remarkable when the region measured is small as in this case. Therefore, when the data was analyzed, this influence was eliminated using a Spline hyper filter with a cut-off wavelength corresponding to a half of the length in the measurement direction (about 3 μm). In order to calibrate the apparatus, SHS Thin Step Height Standard (Steps 18 nm, 88 nm, and 450 nm) manufactured by VLSI standards Inc. traceable to the U.S. national research institute NIST was used.

The test results are shown in Table 6. In each of Sample Nos. 1 to 5, the oxide primarily composed of Zn contains a proper amount of Fe and the coefficient of friction is lower than that of Sample No. 6 (Comparative Example) which does not contain Fe.

TABLE 6

| Sample No. | Activation treatment | Oxidation treatment: Ferrous sulfate heptahydrate (g/l) | Oxidation treatment: pH | Average thickness of oxide layer in planar portion (nm) | Areal rate of oxide primarily composed of Zn (%) | Coefficient of friction | Fe ratio in oxide primarily composed of Zn (%) | Remarks | |
|---|---|---|---|---|---|---|---|---|---|
| 1 | Performed | 20 | 2 | 31 | 43 | 0.165 | 8 | EP | |
| 2 | Performed | 40 | 2 | 19 | 82 | 0.156 | 18 | EP | |
| 3 | Performed | 40 | 2 | 18 | 90 | 0.158 | 21 | EP | |
| 4 | Performed | 40 | 1.5 | 22 | 92 | 0.163 | 20 | EP | |
| 5 | Performed | 80 | 2 | 23 | 95 | 0.162 | 25 | EP | |
| 6 | Performed | 0 | 1.5 | 29 | 46 | 0.182 | <1* | CE | |
| 7 | Not performed | Not performed | | 5 | — | 0.281 | — | CE | As galvanized |

*Fe intensity was less than the lower detection limit of the detector.
EP: Example of Present Invention
CE: Comparative Example

Embodiment 4

Since a hot-dip galvanized steel sheet is usually produced by dipping a steel sheet in a zinc bath containing a very small amount of Al, the plating layer is substantially composed of the η phase, and the Al-based oxide layer resulting from Al contained in the zinc bath is formed on the surface. The η phase is softer than the ξ phase or the δ phase which is the alloy phase of a hot-dip galvannealed steel sheet, and the melting point of the η phase is lower. Consequently, adhesion is likely to occur and sliding performance is poor during press forming. However, in the case of the hot-dip galvanized steel sheet, since the Al-based oxide layer is formed on the surface, an effect of preventing adhesion to the die is slightly exhibited. In particular, when the hot-dip galvanized steel sheet slides over a die and when the sliding distance is short, degradation in the sliding performance may not occur. However, since the Al-based oxide layer formed on the surface is thin, as the sliding distance is increased, adhesion becomes likely to occur, and it is not possible to obtain satisfactory press formability under the extended sliding conditions. Furthermore, the hot-dip galvanized steel sheet is soft and more easily adheres to the die compared with other types of plating. When the surface pressure is low, the sliding performance is degraded.

In order to prevent adhesion between the hot-dip galvanized steel sheet and the die, it is effective to form a thick oxide layer on the surface of the steel sheet. Consequently, it is important to form a Zn-based oxide layer by partially breaking down the Al-based oxide layer on the surface of the plating layer, followed by oxidation. Furthermore, by forming the Zn-based oxide so as to have a network structure, sliding friction can be further decreased. Herein, the network structure is defined as microirregularities including convexities and discontinuous concavities surrounded by the convexities. It is not necessary that the convexities around the concavities have the same height. The heights of the convexities may vary to a certain extent. What matters is that microconcavities are dispersed. With respect to the structure of the microirregularities, for example, the surface of the Zn-based oxide layer may have microirregularities. Alternatively, a Zn-based oxide in a granular, tabular, or scaly shape may be distributed directly on the surface of the plating layer or on the oxide layer and/or hydroxide layer.

The sliding friction is reduced by the microirregularities because the concavities of the microirregularities are believed to function as a group of fine oil pits so that a lubricant can be effectively caught therein. That is, in addition to the sliding friction reducing effect as the oxide, a further sliding friction reducing effect is believed to be exhibited because of the fine sump effect in which the lubricant is effectively retained in the sliding section. Such a lubricant-retaining effect of the microirregularities is particularly effective in stably reducing the sliding friction of the hot-dip galvanized layer which has a relatively smooth surface macroscopically, in which a lubricant is not easily retained macroscopically, and on which it is difficult to stably form a macroscopic surface roughness by rolling or the like in order to achieve lubricity. The lubricant-retaining effect of the microirregularities is particularly effective under the sliding conditions in which the contact surface pressure is low.

The size of the microirregularities can be defined by the average roughness determined based on the roughness curve and the mean spacing S of local irregularities. In the present invention, it has been confirmed that the sliding friction reducing effect can be achieved if Ra is in the range of 4 to 100 nm and S is in the range of 10 to 1,000 nm. Even if Ra and S are increased from the above upper limits, the lubricant-retaining effect is not substantially improved, and it becomes necessary to apply the oxide thickly, resulting in a difficulty in production. If the microirregularities become too small, the surface becomes close to a smooth surface, resulting in a reduction in the viscous oil-retaining effect, which is not advantageous.

In the hot-dip galvanized steel sheet, as will be described below, since the concavities to which the roller for temper rolling is brought into contact with are more active compared with the planar convexities, the oxide is more easily generated. Consequently, in some cases, the oxide formed on the concavities may become coarser than the oxide on the planar portions. Although such nonuniformity does not degrade the advantage of the present invention, it has been confirmed that by setting Ra of the microirregularities of the oxide formed at least on the planar portions at 500 nm, the sliding friction reducing effect can be obtained more stably. The reason for this is believed to be that since the oxide on the planar portions are directly in contact with the tool during sliding, an adverse effect is produced by the coarse oxide in which the fracture resistance of the oxide is increased rather than the lubricant-retaining effect is exhibited.

One of the methods effective in controlling Ra and S is to incorporate Fe into the Zn-based oxide as will be described below. If Fe is incorporated into the Zn-based oxide, the Zn oxide gradually becomes finer and the number of pieces increases with the Fe content. By controlling the Fe content and the growth time, it is possible to adjust the size and distribution of the Zn oxide, and thereby Ra and S can be adjusted. This is not restricted by the shape of the microirregularities.

The surface roughness parameters, i.e., Ra and S, can be calculated according to the formulae described in Japan Industrial Standard B-0660-1998 "Surface roughness—Terms", etc., based on the roughness curve with a length of several microns extracted from the digitized surface shape of the Zn-based oxide using a scanning electron microscope or scanning probe microscope (such as an atomic force microscope) having three-dimensional shape measuring function. The shape of the microirregularities can be observed using a high-resolution scanning electron microscope. Since the thickness of the oxide is small at about several tens of nanometers, it is effective to observe the surface at a low accelerating voltage, for example, at 1 kV or less. In particular, if the secondary electron image is observed by excluding secondary electrons with low energy of about several electron volts as electron energy, it is possible to reduce contrast caused by the electrostatic charge of the oxide. Consequently, the shape of the microirregularities can be observed satisfactorily (refer to Nonpatent Literature 1).

The method for forming the microirregularities in the Zn-based oxide is not particularly limited. One of the effective methods is to incorporate Fe into the Zn-based oxide. By incorporating Fe into the Zn-based oxide, the size of the Zn-based oxide can be miniaturized. An aggregate of the miniaturized oxide pieces makes microirregularities. Although the reason why the oxide containing Zn and Fe is formed into an oxide having microirregularities is not clear, it is assumed that the growth of the Zn oxide is inhibited by Fe or the oxide of Fe. Although the preferable ratio (percent) of Fe to the sum of Zn and Fe is not clarified, the present inventors have confirmed that the Fe content of at least 1 to 50 atomic percent is effective. Such an oxide containing Zn and Fe is formed by incorporating Fe into the acidic solution in the method in which the hot-dip galvanized steel sheet is brought into contact with the acidic solution having the pH buffering effect which will be describe below. Although the concentration is not particularly limited, for example, by in incorporating ferrous sulfate (heptahydrate) in the range of 5 to 400 g/l with the other conditions being the same as those described above, the formation is enabled. In addition, by forming the Zn-based oxide having microirregularities so as to cover substantially most of the surface of the plating layer (at an areal rate of 70% or more), the effect of the oxide can be obtained effectively.

In the regions in which the Al-based oxide layer on the plating layer is partially broken down and a new surface is exposed, the reactivity is increased, and the Zn-based oxide can be easily generated. In contrast, the region in which the Al-based oxide layer remains is inactive, and the oxidation does not advance. In the region in which the Zn-based oxide is formed, since the thickness of the oxide layer can be easily controlled, it is possible to obtain the thickness of the oxide layer required for improving the sliding performance. During actual press forming, the die is brought into contact with the oxide layer including the Zn-based oxide and the Al-based oxide. Even if the Al-based oxide layer is scraped away to cause a state in which adhesion easily occurs depending on the sliding conditions, since the Zn-based oxide layer can exhibit the adhesion-preventing effect, it is possible to improve the press formability.

When the thickness of the oxide layer is controlled, if a large thickness is attempted to be obtained, the thickness of the region in which the Zn-based oxide is present becomes large and the thickness of the region in which the Al-based oxide layer remains does not become large. Consequently, an oxide layer with a nonuniform thickness in which thick regions and thin regions are present is formed over the entire surface of the plating layer. However, because of the same mechanism as that described above, it is possible to improve the sliding performance. In addition, even if the thin regions partially do not include the oxide layer for some reason, it is possible to improve the sliding performance because of the same mechanism.

By setting the average thickness of the oxide layer at 10 nm or more, satisfactory sliding performance can be obtained. To set the average thickness of the oxide layer at 20 nm or more is more effective. The reason for this is that in press working in which the contact area between the die and the workpiece is large, even if the surface region of the oxide layer is worn away, the oxide layer remains, and thus the sliding performance is not degraded. On the other hand, although there is no upper limit for the average thickness of the oxide layer in view of the sliding performance, if a thick oxide layer is formed, the reactivity of the surface is extremely decreased, and it becomes difficult to form a chemical conversion coating. Therefore, the average thickness of the oxide layer is desirably 200 nm or less.

Additionally, the average thickness of the oxide layer can be determined by Auger electron spectroscopy (AES) combined with Ar ion sputtering. In this method, after sputtering is performed to a predetermined depth, the composition at the depth is determined based on the correction of the spectral intensities of the individual elements to be measured using relative sensitivity factors. The O content resulting from oxides reaches the maximum value at a certain depth (which may be the outermost layer), then decreases, and becomes constant. The thickness of the oxide is defined as a depth that corresponds to a half of the sum of the maximum value and the constant value at a position deeper than the maximum value.

In the hot-dip galvanized steel sheet, since the Zn-plating layer is softer and has a lower melting point compared with other types of plating, sliding performance easily changes with the surface pressure, and the sliding performance is low at low surface pressures. In order to overcome this problem, an oxide with a thickness of 10 nm or more (more preferably 20 nm or more) must also be disposed on the convexities and/or planar portions other than the convexities of the surface of the plating layer formed by rolling. That is, in order to display the effect more satisfactorily, the oxide primarily composed of Zn must cover the surface of the plating layer sufficiently, and the coverage must be at least 70% on a given surface of the plating layer. The coverage of the oxide primarily composed of Zn can be measured by element mapping using an X-ray microanalyzer (EPMA) or a scanning electron microscope (SEM). In the EPMA, the intensities or the ratio of O, Al, and Zn resulting from the key oxide are preliminarily obtained, and data of the element mapping measured based on this is processed. Thereby, the areal rate can be estimated. On the other hand, it is possible to estimate the areal rate more simply by SEM image observation using an electron beam at an accelerating voltage of about 0.5 kV. Under this condition, since the portion in which the oxide is formed and the portion in which the oxide is not formed on the surface can be clearly distinguished, the areal rate can be measured by binarizing the resultant secondary electron image using an image processing software. However, it is necessary to preliminarily confirm by AES, EDS, or the like if the observed contrast corresponds to the key oxide.

In order to form the oxide layer, a method is effective in which a hot-dip galvanized steel sheet is brought into contact with an acidic solution having a pH buffering effect, allowed to stand for 1 to 30 seconds, and then washed with water, followed by drying.

Although the mechanism of the formation of the oxide layer is not clear, it is thought to be as follows. When the hot-dip galvanized steel sheet is brought into contact with the acidic solution, zinc on the surface of the steel sheet starts to be dissolved. When zinc is dissolved, hydrogen is also generated. Consequently, as the dissolution of zinc advances, the hydrogen ion concentration in the solution decreases, resulting in an increase in the pH of the solution. A Zn-based oxide layer is thereby formed on the surface of the hot-dip galvanized steel sheet. As described above, in order to form the Zn-based oxide, zinc must be dissolved and the pH of the solution in contact with the steel sheet must be increased. Therefore, it is effective to adjust the retention time after the steel sheet is brought into contact with the acidic solution until washing with water is performed. If the retention time is less than one second, the liquid is washed away before the pH of the solution with which the steel sheet is in contact is increased. Consequently, it is not possible to form the oxide. On the other hand, even if the steel sheet is allowed to stand for 30 seconds or more, there is no change in the formation of the oxide.

In the present invention, the retention time until washing with water is performed is important to the formation of the oxide. During the retention period, the oxide (or hydroxide) having the particular microirregularities grows. The more preferable retention time is 2 to 10 seconds.

The acidic solution used for the oxidation treatment preferably has a pH of 1.0 to 5.0. If the pH exceeds 5.0, the dissolution rate of zinc is decreased. If the pH is less than 1.0, the dissolution of zinc is excessively accelerated. In either case, the formation rate of the oxide is decreased. Preferably, a chemical solution having a pH buffering effect is added to the acidic solution. By using such a chemical solution, pH stability is imparted to the treatment liquid during the actual production. In the process in which Zn-based oxide is formed due to the increase in pH in response to the dissolution of Zn, a local increase in pH is also prevented, and by providing the proper reaction time, the oxide growth time can be secured. Thereby, the oxide having microirregularities characterized in the present invention is effectively formed.

Any chemical solution which has a pH buffering effect in the acidic range may be used. Examples thereof include acetates, such as sodium acetate ($CH_3COONa$); phthalates, such as potassium hydrogen phthalate ($(KOOC)_2C_6H_4$); citrates, such as sodium citrate ($Na_3C_6H_5O_7$) and potassium dihydrogen citrate ($KH_2C_6H_5O_7$); succinates, such as sodium succinate ($Na_2C_4H_4O_4$); lactates, such as sodium lactate ($NaCH_3CHOHCO_2$); tartrates, such as sodium tartrate ($Na_2C_4H_4O_6$); borates; and phosphates. These may be used alone or in combination of two or more.

The concentration of the chemical solution is preferably 5 to 50 g/l. If the concentration is less than 5 g/l, the pH buffering effect is insufficient, and it is not possible to form a desired oxide layer. If the concentration exceeds 50 g/l, the effect is saturated, and it also takes a long time to form the oxide. By bringing the galvanized steel sheet into contact with the acidic solution, Zn from the plating layer is dissolved in the acidic solution, which does not substantially prevent the formation of the Zn oxide. Therefore, the Zn concentration in the acidic solution is not specifically defined. As a more preferable pH buffering agent, a solution containing sodium acetate trihydrate in the range of 10 to 50 g/l, more preferably in the range of 20 to 50 g/l, is used. By using such a solution, the oxide of the present invention can be effectively obtained.

The method for bringing the galvanized steel sheet into contact with the acidic solution is not particularly limited. For example, a method in which the galvanized steel sheet is immersed in the acidic solution, a method in which the acidic solution is sprayed to the galvanized steel sheet, or a method in which the acidic solution is applied to the galvanized steel sheet using an application roller may be employed. Desirably, the acidic solution is applied so as to be present in a thin liquid film form on the surface of the steel sheet. If the amount of the acidic solution present on the surface of the steel sheet is large, even if zinc is dissolved, the pH of the solution is not increased, and only the dissolution of zinc occurs continuously. Consequently, it takes a long time to form the oxide layer, and the plating layer is greatly damaged. The original rust-preventing function of the steel sheet may be lost. From this viewpoint, the amount of the liquid film is preferably adjusted to 3 $g/m^2$ or less. The amount of the liquid film can be adjusted by squeeze rolling, air wiping, or the like.

The hot-dip galvanized steel sheet must be temper-rolled before the process of forming the oxide layer. The temper rolling operation is usually performed primarily in order to adjust the material quality. In the present invention, the temper rolling operation is also performed to partially break down the Al-based oxide layer present on the surface of the steel sheet.

The present inventors have observed the surface of the galvanized steel sheet before and after the formation of the oxide using a scanning electron microscope and found that the Zn-based oxide layer is mainly formed in the regions in which the Al-based oxide layer is broken down by the convexities of fine irregularities of the surface of the roller when the roller is brought into contact with the surface of the plating layer during temper rolling. Consequently, by controlling the roughness of the surface of the roller for temper rolling and elongation during temper rolling, the area of the broken down Al-based oxide layer can be controlled, and thereby the areal rate and distribution of the Zn-based oxide layer can be controlled. Additionally, concavities can also be formed on the surface of the plating layer by such a temper rolling operation.

The example in which temper rolling is performed has been described above. Any other techniques which can mechanically break down the Al-based oxide layer on the surface of the plating layer may be effective in forming the Zn-based oxide and controlling the areal rate. Examples thereof include processing using a metallic brush and shot blasting.

It is also effective to perform activation treatment before the oxidation treatment, in which the steel sheet is brought into contact with an alkaline solution to activate the surface. This treatment is performed to further remove the Al-based oxide and to expose a new surface. In the temper rolling operation described above, there may be a case in which the Al-based oxide layer is not broken down sufficiently depending on the type of the steel sheet because of the elongation restricted by the material. Therefore, in order to stably form an oxide layer having excellent sliding performance regardless of the type of the steel sheet, it is necessary to activate the surface by further removing the Al-based oxide layer.

As a result of various research on the Al-based oxide on the surface, which has been obtained when the Al-based oxide layer is removed by contact with an alkaline solution or the like, the preferred state of the Al-based oxide layer which is effective in forming the oxide primarily composed of Zn having the microirregularities defined in the present invention is as follows.

It is not necessary to completely remove the Al-based oxide on the surface and the Al-based oxide may be present along with the Zn-based oxide on the surface of the plating layer. Preferably, the average concentration of Al which is contained in the oxide on the planar portions on the surface is less than 20 atomic percent. The Al concentration is defined as the maximum value of the Al concentration within the depth corresponding to the thickness of the oxide when the average thickness of the oxide and the distribution of the Al concentration in the depth direction in a range of about 2 μm×2 μm are measured by Auger electron spectroscopy (AES) and Ar sputtering.

If the Al concentration is 20 atomic percent or more, it becomes difficult to form the oxide primarily composed of Zn having local microirregularities, resulting in a difficulty in covering the surface of the plating layer with the oxide primarily composed of Zn at an areal rate of 70% or more. Consequently, sliding performance, in particular, sliding performance under the conditions of low surface pressure, chemical conversion treatability, and bondability are decreased.

In order to produce the state of the Al-based oxide described above, contact with an aqueous alkaline solution is effective. In such a case, preferably, the pH of the aqueous solution is set at 11 or more, the bath temperature is set at 50° C. or more, and the contact time with the solution is set to be one second or more. Any type of solution may be used as long as its pH is within the above range. For example, sodium hydroxide or a sodium hydroxide-based degreaser may be used.

The activation treatment must be performed before the oxidation treatment and may be performed before or after the temper rolling operation performed after hot-dip galvanizing. However, if the activation treatment is performed after the temper rolling operation, since the Al-based oxide is mechanically broken down at the concavities formed by crushing with the roller for temper rolling, the removal amount of the Al oxide tends to vary depending on the concavities and the convexities and/or planar portions other than the concavities. Consequently, in some case, the amount of the Al oxide may become nonuniform in the plane after the activation treatment, and the subsequent oxidation treatment may become nonuniform, resulting in a difficulty obtaining satisfactory characteristics.

Therefore, a process is preferable in which, after plating, activation treatment is performed first so that a proper amount of the Al oxide is removed uniformly in the plane, temper rolling is then performed, and subsequently oxidation treatment is performed.

When the hot-dip galvanized steel sheet of the present invention is produced, Al must be incorporated into the plating bath. The additive elements other than Al are not particularly limited. That is, the advantage of the present invention is not degraded even if Pb, Sb, Si, Sn, Mg, Mn, Ni, Ti, Li, Cu, or the like is incorporated besides Al. The advantage of the present invention is also not degraded even if a very small amount of P, S, N, B, Cl, Na, Mn, Ca, Mg, Ba, Sr, Si, or the like is incorporated into the oxide layer due to the inclusion of impurities during oxidation.

The present invention will be described in more detail based on the example below.

EXAMPLE

A hot-dip galvanized layer was formed on a cold-rolled steel sheet with a thickness of 0.8 mm, and then temper rolling was performed. Before or after the temper rolling operation, activation treatment was performed by bringing each sample into contact with a solution of sodium hydroxide-based degreaser FC-4370 manufactured by Nihon Parkerizing Co., Ltd. for a predetermined time. In order to form the oxide, each sample subjected to the activation treatment and the temper rolling operation was immersed in an acidic solution with varied contents of sodium acetate trihydrate and ferrous sulfate heptahydrate and with varied pH for 2 to 5 seconds. The amount of the liquid on the surface of the sample was adjusted to 3 $g/m^2$ or less by squeeze rolling, and the sample was left to stand in air for 5 seconds. For comparison, a sample which was not subjected to activation treatment and oxidation treatment (as hot-dip galvanized) and a sample which was subjected to oxidation treatment without activation treatment were also prepared.

With respect to each sample thus prepared, a press formability test was performed in which sliding performance was evaluated, and in order to evaluate the surface shape, the thickness of the oxide layer, the coverage of the oxide, and the shape of microirregularities were measured. Methods for characteristics evaluation and film analysis will be described below.

(1) Press Formability (Sliding Performance) Evaluation (Measurement of Coefficient of Friction)

The coefficient of friction of each sample was measured as in the first embodiment.

(2) Measurement of Thickness of Oxide Layer

The distribution in the depth direction of composition on the surface of the plating layer was determined using Auger electron spectroscopy (AES) by repeating $Ar^+$ sputtering and AES spectrum analysis. The sputtering time was converted to the depth according to the sputtering rate obtained by measuring a $SiO_2$ film with a known thickness. The composition (atomic percent) was determined based on the correction of the Auger peak intensities of the individual elements using relative sensitivity factors. In order to eliminate the influence of contamination, C was not taken into consideration. The O concentration resulting from oxides and hydroxides is high in the vicinity of the surface, decreases with depth, and becomes constant. The thickness of the oxide is defined as a depth that corresponds to a half of the sum of the maximum value and the constant value. A region of about 2 μm×2 μm in the planar portion was analyzed, and the average of the thicknesses measured at 2 to 3 given points was defined as the average thickness of the oxide layer.

(3) Measurement of Areal Rate of Oxide Primarily Composed of Zn

In order to measure the areal rate of the oxide primarily composed of Zn, a scanning electron microscope (LEO1530 manufactured by LEO Company) was used, and a secondary electron image at a low magnification was observed at an accelerating voltage of 0.5 kV with an in-lens secondary electron detector. Under these observation conditions, the region in which the oxide primarily composed of Zn was formed was clearly distinguished as dark contrast from the region in which such an oxide was not formed. The resultant secondary electron image was binarized by an image processing software, and the areal rate of the dark region was calculated to determine the areal rate of the region in which Zn-based oxide was formed.

(4) Measurement of Shape of Microirregularities and Roughness Parameters of Oxide The formation of the microirregularities of the Zn-based oxide was confirmed by a method in which, using a scanning electron microscope (LEO1530 manufactured by LEO Company), a secondary electron image at a high magnification was observed with an Everhart-Thornly secondary electron detector placed in a sample chamber at an accelerating voltage of 0.5 kV.

In order to measure the surface roughness of the Zn-based oxide, a three dimensional electron probe surface roughness analyzer (ERA-8800FE manufactured by Elionix Inc.) was used. The measurement was performed at an accelerating voltage of 5 kV and a working distance of 15 mm. Sampling distance in the in-plane direction was set at 5 nm or less (at an observation magnification of 40,000 or more). Additionally, in order to prevent electrostatic charge build-up due to the electron beam irradiation, gold vapor deposition was performed. For each region in which the Zn-based oxide was present, 450 or more roughness curves with a length of about 3 μm in the scanning direction of the electron beam were extracted. At least three locations were measured for each sample.

Based on the roughness curves, using an analysis software attached to the apparatus, the average surface roughness (Ra) of the roughness curves and the mean spacing (S) of local irregularities of the roughness curves were calculated. Herein, Ra and S are parameters for evaluating the roughness of the microirregularities and the period, respectively. The general definitions of these parameters are described in Japan Industrial Standard B-0660-1998 "Surface roughness—Terms", etc. In the present invention, the roughness parameters are based on roughness curves with a length of several micrometers, and Ra and S are calculated according to the formulae defined in the literature described above.

When the surface of the sample is irradiated with an electron beam, contamination primarily composed of carbon may grow and appear in the measurement data. Such an influence is likely to become remarkable when the region measured is small as in this case. Therefore, when the data was analyzed, this influence was eliminated using a Spline hyper filter with a cut-off wavelength corresponding to a half of the length in the measurement direction (about 3 μm). In order to calibrate the apparatus, SHS Thin Step Height Standard (Steps 18 nm, 88 nm, and 450 nm) manufactured by VLSI standards Inc. traceable to the U.S. national research institute NIST was used.

The test results are shown in Table 6. The followings are evident from the results shown in Table 6.

In each of Sample Nos. 1 to 6, since the thickness of the oxide primarily composed of Zn formed in the planar portion, the areal rate, and the shape of microirregularities are in the ranges of the present invention, the coefficient of friction are low.

In Sample No. 7, the thickness of the oxide primarily composed of Zn and the areal rate are satisfactory. However, since microirregularities are not formed properly, the reduction in the coefficient of friction is small.

In Sample No. 8, since activation treatment is not performed, the oxide is not formed sufficiently.

TABLE 7

| Sample No. | Activation treatment | Oxidation treatment: Sodium acetate trihydrate (g/l) | Oxidation treatment: Ferrous sulfate heptahydrate (g/l) | pH | Average thickness of oxide layer in planar portion (nm) | Areal rate of oxide primarily composed of Zn (%) | Coefficient of friction | Shape of microirregularities of oxide primarily composed of Zn: Planar portion Ra (nm) | Planar portion S (nm) | Temper-rolled concavity Ra (nm) | Temper-rolled concavity S (nm) | Remarks |
|---|---|---|---|---|---|---|---|---|---|---|---|---|
| 1 | Performed | 40 | 0 | 1.5 | 28 | 91 | 0.176 | 71 | 540 | 82 | 780 | EP |
| 2 | Performed | 40 | 0 | 2 | 24 | 93 | 0.167 | 45 | 421 | 47 | 433 | EP |
| 3 | Performed | 40 | 0 | 2 | 18 | 91 | 0.160 | 11 | 168 | 52 | 612 | EP |
| 4 | Performed | 40 | 40 | 2 | 21 | 96 | 0.156 | 13 | 124 | 13 | 131 | EP |
| 5 | Performed | 40 | 80 | 2 | 23 | 95 | 0.162 | 5.2 | 42 | 4.6 | 46 | EP |
| 6 | Performed | 40 | 0 | 3 | 17 | 98 | 0.169 | 4.2 | 113 | 49 | 523 | EP |
| 7 | Performed | 20 | 0 | 4 | 13 | 92 | 0.182 | 2.3 | 53 | 23 | 421 | CE |
| 8 | Not performed | 40 | 0 | 2 | 8 | 12 | 0.250 | — | — | 18 | 620 | CE |
| 9 | Not performed | Not performed | | | 5 | — | 0.281 | 1.3* | 64* | 1.6* | 70* | CE |

*Original irregularities of the surface of the plating layer instead of the oxide primarily composed of Zn
EP: Example of Present Invention
CE: Comparative Example

What is claimed is:

1. A hot-dip galvanized steel sheet comprising:

a plating layer consisting essentially of a η phase; and an oxide layer disposed on a surface of the plating layer, said oxide layer having an average thickness of 10 nm or more; and the oxide layer comprising a Zn-based oxide layer and an Al-based oxide layer, the Zn-based oxide layer having a Zn/Al atomic concentration ratio of more than 1 and the Al-based oxide layer having a Zn/Al atomic concentration ratio of less than 1, wherein the Zn-based oxide layer has microirregularities; and the microirregularities have a mean spacing (S) determined based on a roughness curve of 1,000 nm or less and an average roughness (Ra) of 100 nm or less.

2. The hot-dip galvanized steel sheet according to claim 1, wherein the plating layer has concavities and convexities on the surface thereof; and the Zn-based oxide layer is disposed at least on the concavities.

3. The hot-dip galvanized steel sheet according to claim 1, wherein the Zn-based oxide layer comprises an oxide containing Zn and Fe; and the Zn-based oxide layer has a Fe atomic concentration ratio of 1 to 50 atomic percent, the atomic concentration ratio being defined by an expression Fe/(Zn+Fe).

4. The hot-dip galvanized steel sheet according to claim 1, wherein the Zn-based oxide layer has an areal rate of 15% or more with respect to the surface of the plating layer.

5. The hot-dip galvanized steel sheet according to claim 1, wherein the oxide layer has an average thickness of 10 to 200 nm.

6. The hot-dip galvanized steel sheet according to claim 1, wherein the Zn-based oxide layer has microirregularities with a network structure including convexities and discontinuous concavities surrounded by the convexities.

7. The hot-dip galvanized steel sheet according to claim 1, wherein the Zn-based oxide layer has a Zn/Al atomic concentration ratio of 4 or more.

8. The hot-dip galvanized steel sheet according to claim 7, wherein the Zn-based oxide layer has an areal rate of 70% or more with respect to the surface of the plating layer.

9. The hot-dip galvanized steel sheet according to claim 7, wherein the Zn-based oxide layer is disposed on the concavities of the surface of the plating layer formed by temper rolling, and on the convexities or planar portions other than the concavities.

10. The hot-dip galvanized steel sheet according to claim 7, wherein the Zn-based oxide layer comprises an oxide containing Zn and Fe; and the Zn-based oxide layer has a Fe atomic concentration ratio defined by an expression Fe/(Zn+Fe) being 1 to 50 atomic percent.

11. The hot-dip galvanized steel sheet according to claim 7, wherein the Zn-based oxide layer has microirregularities; and the Zn-based oxide layer has a network structure that is formed by convexities and discontinuous concavities surrounded by the convexities.

12. A hot-dip galvanized steel sheet, comprising a plating layer consisting essentially of a η phase; and a Zn-based oxide layer containing Fe disposed on the surface of the plating layer, the Zn-based oxide layer having an Fe atomic concentration ratio of 1 to 50 atomic percent, the Fe atomic concentration ratio being defined by the expression Fe/(Fe+Zn), wherein the Zn-based oxide layer has a mean spacing (S) determined based on a roughness curve being 10 to 1,000 nm and an average roughness (Ra) of 4 to 100 nm.

13. The hot-dip galvanized steel sheet according to claim 12, wherein the Zn-based oxide layer has microirregularities with a network structure including convexities and discontinuous concavities surrounded by the convexities.

14. The hot-dip galvanized steel sheet according to claim 12, wherein the Zn-based oxide layer has an areal rate of 15% or more with respect to the surface of the plating layer.

15. A hot-dip galvanized steel sheet, comprising a plating layer consisting essentially of a η phase; and a Zn-based oxide layer containing Fe disposed on a surface of the plating layer, the Zn-based oxide layer having microirregularities with a network structure including convexities and discontinuous concavities surrounded by the convexities.

wherein the Zn-based oxide layer has a mean spacing (S) determined based on a roughness curve being 10 to 1,000 nm and an average roughness (Ra) of 4 to 100 nm.

16. The hot-dip galvanized steel sheet according to claim 15, wherein the Zn-based oxide layer has an areal rate of 70% or more with respect to the surface of the plating layer.

17. The hot-dip galvanized steel sheet according to claim 15, wherein the Zn-based oxide layer is disposed on the planar portions of the surface of the plating layer other than the concavities formed by temper rolling.

18. The hot-dip galvanized steel sheet according to claim 17, wherein, the Zn-based oxide layer, which is disposed on the planar portions, has a mean spacing (S) determined based on the roughness curve of 10 to 500 nm and the average roughness (Ra) of 4 to 100 nm.

* * * * *